US011695241B2

(12) United States Patent
Guo et al.

(10) Patent No.: US 11,695,241 B2
(45) Date of Patent: Jul. 4, 2023

(54) ELECTRICAL CONNECTOR ASSEMBLY WITH IMPROVED SHIELDING EFFECT AND LOCKING STRUCTURE

(71) Applicant: DONGGUAN LUXSHARE TECHNOLOGIES CO., LTD, Dongguan (CN)

(72) Inventors: Rongzhe Guo, Dongguan (CN); Bin Huang, Dongguan (CN); Kunlin Yao, Dongguan (CN); Qiongnan Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 64 days.

(21) Appl. No.: 17/513,248

(22) Filed: Oct. 28, 2021

(65) Prior Publication Data

US 2022/0052492 A1 Feb. 17, 2022

Related U.S. Application Data

(63) Continuation-in-part of application No. 17/343,325, filed on Jun. 9, 2021, now Pat. No. 11,616,314.

(30) Foreign Application Priority Data

Jul. 3, 2020 (CN) ..... 202010629625.X

(51) Int. Cl.
*H01R 13/659* (2011.01)
*H01R 12/70* (2011.01)

(52) U.S. Cl.
CPC ..... *H01R 13/659* (2013.01); *H01R 12/7052* (2013.01)

(58) Field of Classification Search
CPC ..... H01R 13/659; H01R 12/7052
(Continued)

(56) References Cited

U.S. PATENT DOCUMENTS 5,336,111 A * 8/1994 Thrush ..... H01R 12/7064 439/567
5,401,187 A * 3/1995 Ortega ..... H01R 12/7064 411/456

(Continued)

FOREIGN PATENT DOCUMENTS

CN 104302099 A * 1/2015 ..... H05K 1/116

*Primary Examiner* — Peter G Leigh
(74) *Attorney, Agent, or Firm* — Birch, Stewart, Kolasch & Birch, LLP

(57) ABSTRACT

An electrical connector assembly includes an electrical connector and a metal casing. The electrical connector includes an insulating body and a number of conductive terminals. The insulating body includes a slot. Each conductive terminal includes an abutting portion. The metal casing includes a receiving cavity. When a mating connector is inserted into the receiving cavity and has not yet made contact with the conductive terminals of the electrical connector, a better shielding effect can be achieved. Some of the abutting portions are adapted for electrically connecting with a circuit board, and some of the abutting portions of the conductive terminals are connected with a cable. The metal casing includes a hook portion locking with a lock surface of the circuit board. Therefore, the metal casing can be prevented from detaching from the circuit board in case an external force is applied to pull the cable.

20 Claims, 29 Drawing Sheets

(58) Field of Classification Search
USPC ..... 439/55
See application file for complete search history.

(56) References Cited

U.S. PATENT DOCUMENTS 5,462,454 A * 10/1995 Kramer ..... H01R 12/7035 439/571
5,951,325 A * 9/1999 Tang ..... H01R 12/7029 439/567
5,957,722 A * 9/1999 Pan ..... H01R 12/7029 439/567
5,989,064 A * 11/1999 Harlan ..... H01R 12/7064 439/567
6,159,043 A * 12/2000 Yao ..... H01R 12/7064 439/567
6,443,768 B1 * 9/2002 Dirkers ..... H05K 9/0058 439/607.2
6,508,670 B1 * 1/2003 Hwang ..... H01R 13/6594 439/607.37
6,541,712 B1 * 4/2003 Gately ..... H05K 1/115 174/262
6,893,294 B2 * 5/2005 Moriyama ..... G02B 6/4292 439/607.2
7,037,136 B1 * 5/2006 Korsunsky ..... H01R 13/6594 361/728
7,037,137 B2 * 5/2006 Lee ..... H01R 13/6594 439/607.06
7,242,586 B2 * 7/2007 Cheng ..... G02B 6/4277 361/728
8,403,695 B2 * 3/2013 Wang ..... H01R 13/6335 439/352
8,926,347 B2 * 1/2015 Zhu ..... H01R 13/6335 439/159
9,728,919 B1 8/2017 Dunwoody et al.
9,985,365 B2 5/2018 Xie et al.
10,114,182 B2 * 10/2018 Zbinden ..... G02B 6/4268
2002/0145856 A1 * 10/2002 Jones ..... H01R 13/6594 361/752
2003/0100204 A1 * 5/2003 Hwang ..... H01R 13/6596 439/92
2004/0118605 A1 * 6/2004 van der Laan ..... H05K 3/429 174/262
2010/0319979 A1 * 12/2010 Hsu ..... H05K 1/0251 174/262
2015/0008029 A1 * 1/2015 Lee ..... H05K 3/429 174/266
2019/0018208 A1 * 1/2019 Zbinden ..... G02B 6/4268

* cited by examiner

ELECTRICAL CONNECTOR ASSEMBLY WITH IMPROVED SHIELDING EFFECT AND LOCKING STRUCTURE

CROSS-REFERENCE TO RELATED APPLICATION

This patent application is a continuation-in-part of U.S. patent application Ser. No. 17/343,325, filed on Jun. 9, 2021 and titled "ELECTRICAL CONNECTOR ASSEMBLY WITH IMPROVED SHIELDING EFFECT AND EASY INSTALLATION", which claims priority under 35 U.S.C. § 119(a) to Application No. 202010629625.X, filed in China on Jul. 3, 2020, all of which are hereby expressly incorporated by reference into the present application.

TECHNICAL FIELD

The present disclosure relates to an electrical connector assembly, which belongs to a technical field of electrical connectors.

BACKGROUND

Electrical connectors usually include an insulating body and a plurality of conductive terminals fixed to the insulating body. Each conductive terminal includes a contact portion for mating with a mating connector and a mounting foot for being mounted to a circuit board. The connection between the mounting foot and the circuit board usually includes through hole soldering, surface soldering and press-fit etc. However, as the requirements for the transmission rate of the electrical connectors become higher and higher, the connection methods of the above-mentioned mounting foot and the circuit board are all facing great challenges. In addition, how to set a shielding structure to reduce interference to signal transmission is also a technical problem that needs to be solved by those of ordinary skill in the art.

Besides, when an electrical connector contains a cable and the electrical connector is mounted to a circuit board, under this circumstance, in case an external force is applied to pull the cable, it could detach the electrical connector from the circuit board. Therefore, how to ensure the electrical connector can be firmly in retention with the circuit board is a problem to be solved.

SUMMARY

An object of the present disclosure is to provide an electrical connector assembly with better shielding effect and improved locking structure.

In order to achieve the above object, the present disclosure adopts the following technical solution: an electrical connector assembly, including: an electrical connector, the electrical connector including an insulating body and a plurality of conductive terminals fixed to the insulating body, the insulating body defining a slot, each conductive terminal including an elastic contact portion and an abutting portion, the elastic contact portions of the conductive terminals protruding into the slot for mating with a mating connector, some of the abutting portions of the conductive terminals being adapted for electrically connecting with a circuit board, and some of the abutting portions of the conductive terminals being connected with a cable; and a metal casing, the metal casing shielding the electrical connector, the metal casing defining a receiving cavity in communication with the slot, the receiving cavity being located at a front end of the slot, and the slot and the receiving cavity being adapted for jointly receiving the mating connector.

In order to achieve the above object, the present disclosure adopts the following technical solution: an electrical connector assembly, including: a first electrical connector assembly; a second electrical connector; and a circuit board, the circuit board including a first side and a second side opposite to the first side; the first electrical connector assembly including: an electrical connector, the electrical connector including an insulating body and a plurality of conductive terminals fixed to the insulating body, the insulating body including a slot, each conductive terminal including an elastic contact portion and an abutting portion, the elastic contact portions of the conductive terminals protruding into the slot for mating with a mating connector, some of the abutting portions of the conductive terminals being adapted for electrically connecting with the circuit board, and some of the abutting portions of the conductive terminals being connected with a cable; and a metal casing, the metal casing shielding the electrical connector, the metal casing defining a receiving cavity in communication with the slot, the receiving cavity being located at a front end of the slot, and the slot and the receiving cavity being adapted for receiving the mating connector; wherein the first electrical connector assembly is mounted to the first side of the circuit board, and the second electrical connector is mounted to the second side of the circuit board.

In order to achieve the above object, the present disclosure adopts the following technical solution: an electrical connector assembly, including: an electrical connector, the electrical connector including an insulating body and a plurality of conductive terminals, the insulating body defining a slot, each conductive terminal including an elastic contact portion and an abutting portion, the elastic contact portions of the conductive terminals protruding into the slot for mating with a mating connector; a metal casing, the metal casing shielding the electrical connector, the metal casing defining a receiving cavity in communication with the slot, and the slot and the receiving cavity being adapted for jointly receiving the mating connector; and a circuit board, the circuit board including a mounting hole and a lock surface; wherein some of the abutting portions of the conductive terminals are adapted for electrically connecting with the circuit board, and some of the abutting portions of the conductive terminals are connected with a cable; and wherein the metal casing includes a locking tab inserted into the mounting hole, and the locking tab includes a hook portion locking with the lock surface in order to prevent the locking tab from being detaching from the circuit board.

Compared with the prior art, the metal casing of the present disclosure defines a receiving cavity at the front end of the slot, when the mating connector is inserted and has not yet been in contact with the conductive terminals of the electrical connector of the present disclosure, a better shielding environment can be provided by the metal casing, thereby the quality of subsequent signal transmission can be improved. In addition, the conductive terminals of the electrical connector of the present disclosure are provided with abutting portions. Some of the abutting portions of the conductive terminals are adapted for electrically connecting with a circuit board, and some of the abutting portions of the conductive terminals are connected with a cable. By making the hook portion of the metal casing locking with the lock surface of the circuit board, the metal casing can be prevented from detaching from the circuit board in case an external force is applied to pull the cable.

BRIEF DESCRIPTION OF DRAWINGS

FIG. 24 is another partial exploded view of the electrical connector assembly shown in

FIG. 23;

DETAILED DESCRIPTION

Figure 1:
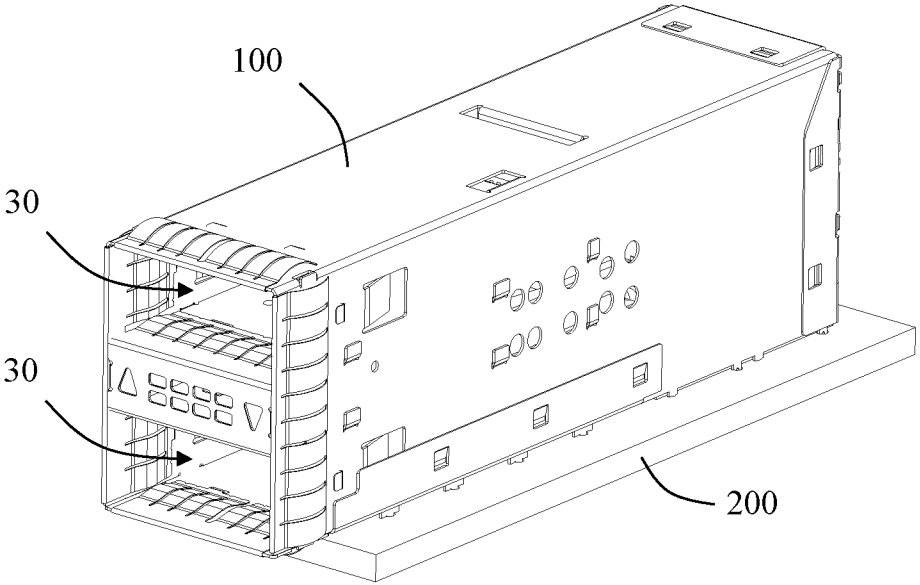
FIG. 1 is a perspective schematic view of an electrical connector assembly when mounted on a circuit board in accordance with a first embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 2:
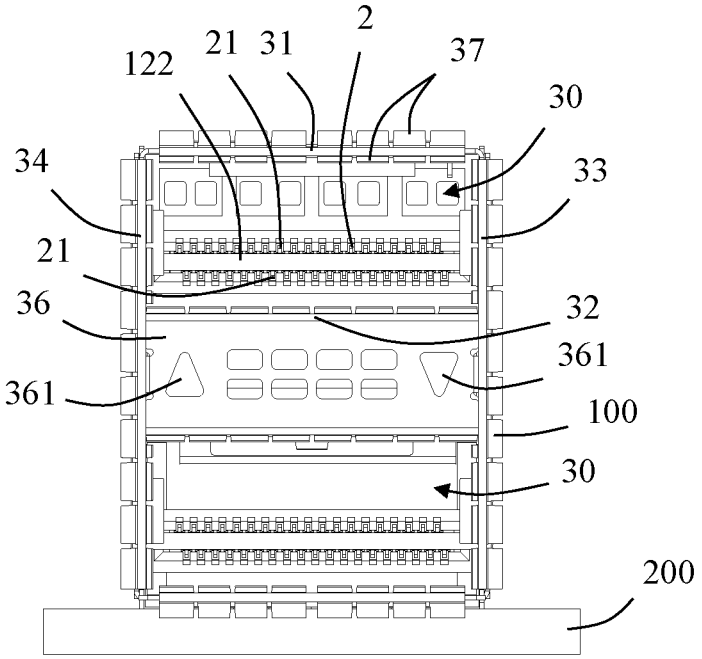
FIG. 2 is a front view of FIG. 1.
Figure 3:
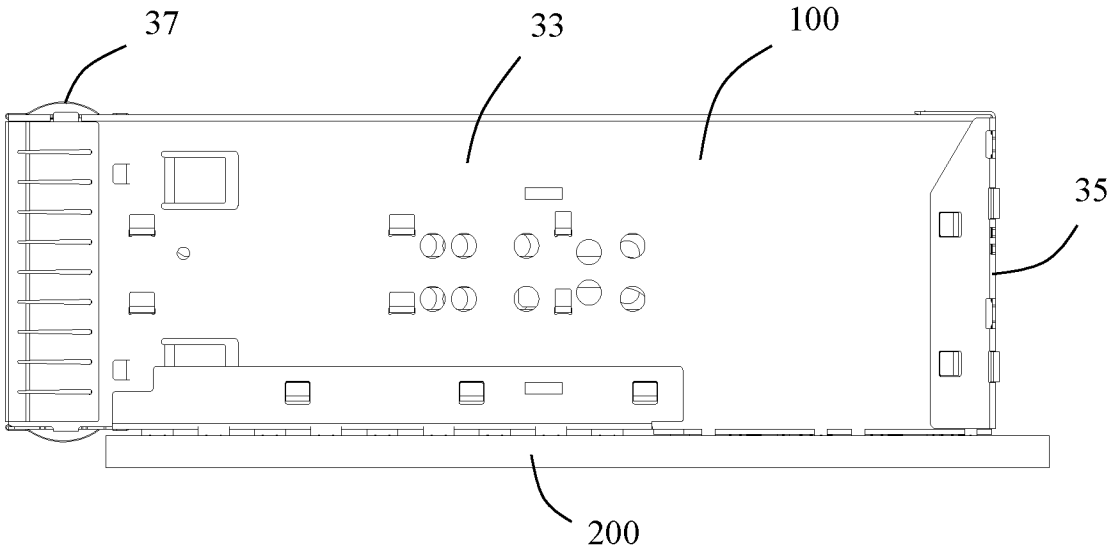
FIG. 3 is a right side view of FIG. 1.
Figure 4:
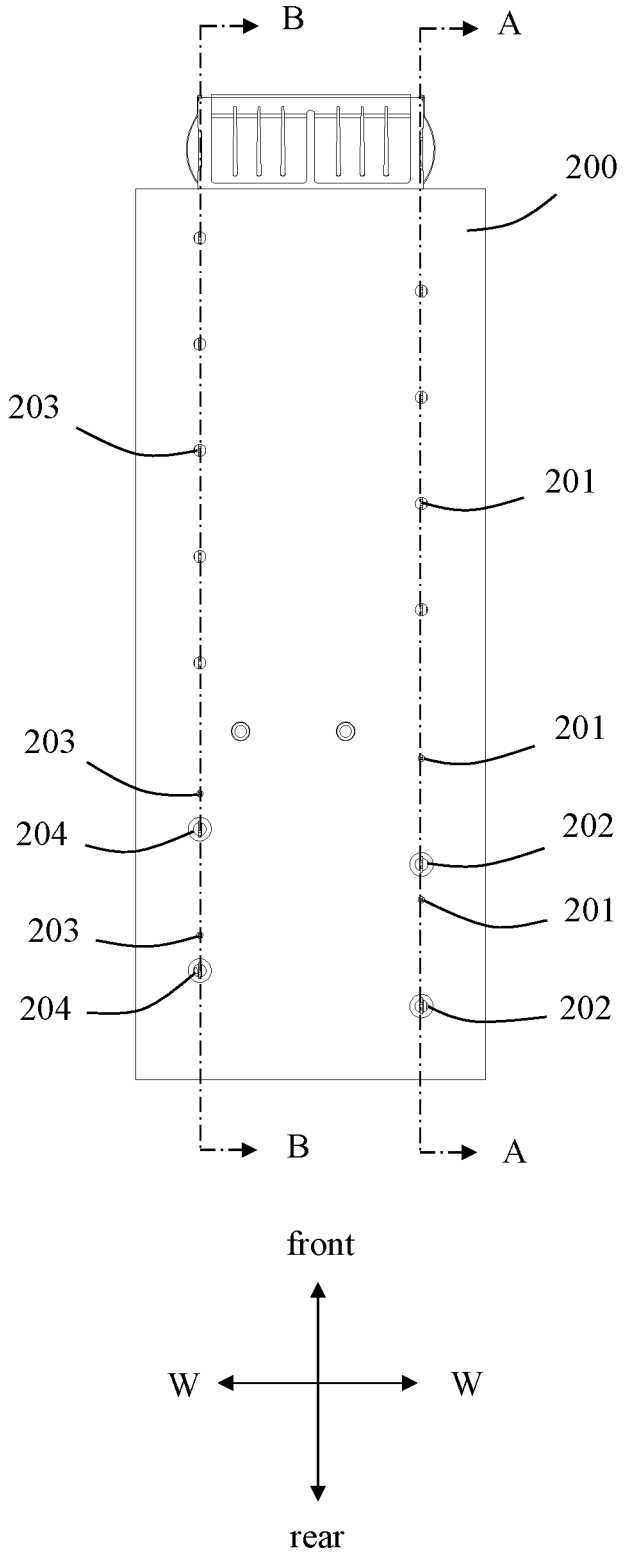
FIG. 4 is a bottom view of FIG. 1.
Figure 5:
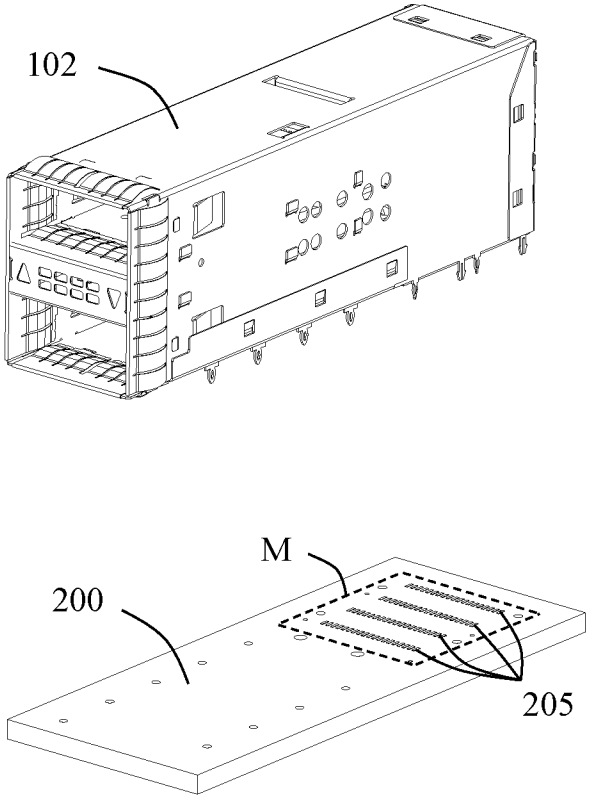
FIG. 5 is a partially exploded perspective view of FIG. 1.
Figure 6:
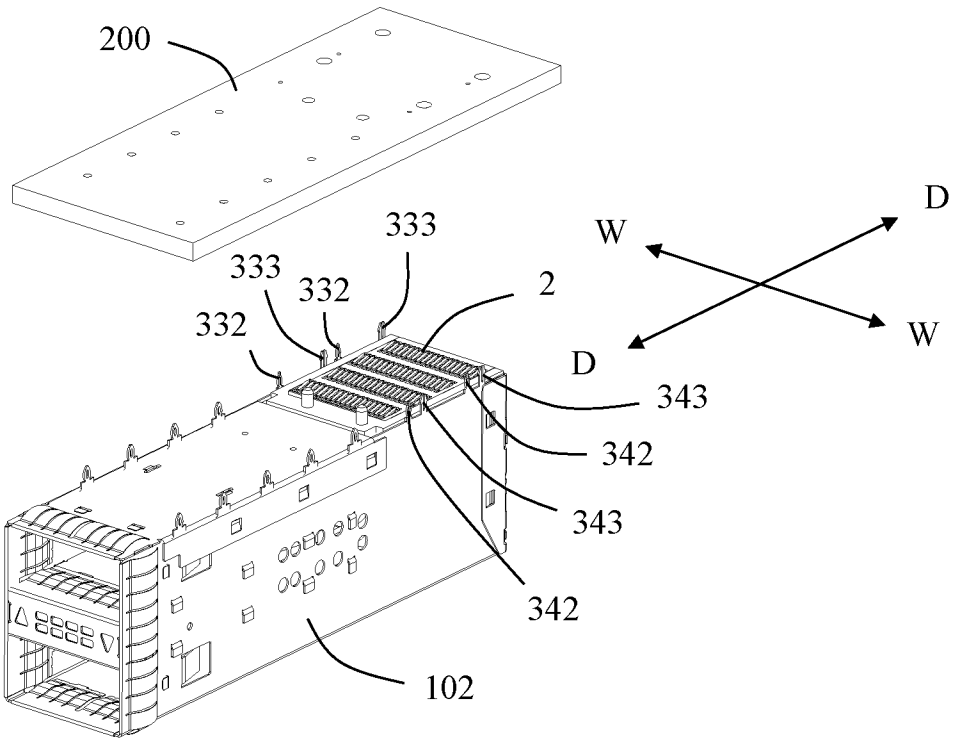
FIG. 6 is a partially exploded perspective view of FIG. 5 from another angle.

Referring to FIGS. 1 to 3, an illustrated embodiment of the present disclosure discloses an electrical connector assembly 100 for being mounted on a circuit board 200. Referring to FIGS. 4 to 6, in a first illustrated embodiment of the present disclosure, the circuit board 200 includes a plurality of first conductive holes 201 and a plurality of first locking holes 202 on one side (for example, a right side in FIG. 4), and a plurality of second conductive holes 203 and a plurality of second locking holes 204 on the other side (for example, a left side in FIG. 4). Two first conductive holes 201 and two first locking holes 202 at a rear end are disposed alternately. Two second conductive holes 203 and two second locking holes 204 at a rear end are disposed alternately. From a perspective of a width direction W-W of the circuit board 200, the first conductive holes 201 and the second conductive holes 203 are arranged staggered (that is, not aligned), and the first locking holes 202 and the second locking holes 204 are arranged staggered (that is, not aligned). This arrangement facilitates the installation of electrical connectors on opposite sides of the circuit board 200 so as to achieve a modular arrangement. Referring to FIG. 5, in an area M where the two first conductive holes 201, the two first locking holes 202, the two second conductive holes 203 and the two second locking holes 204 are located, the circuit board 200 further includes multiple rows of conductive pads 205 (also called "golden fingers"). In the illustrated embodiment of the present disclosure, the conductive pads 205 are in four rows.

Figure 7:
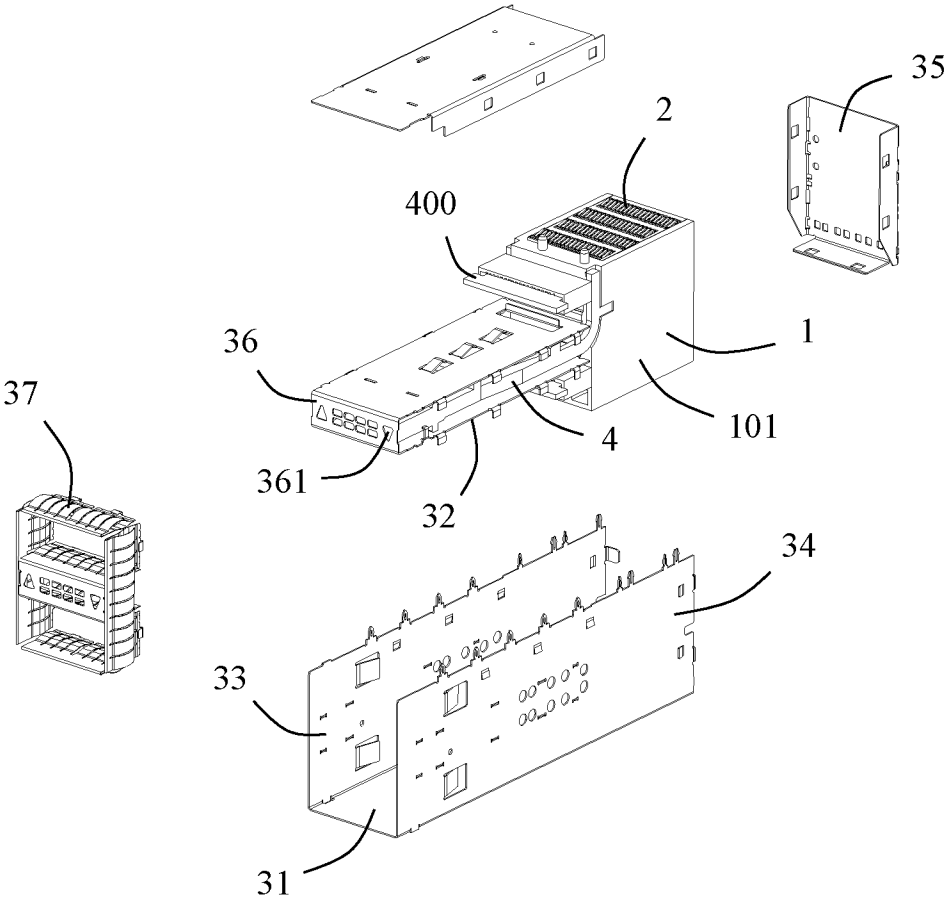
FIG. 7 is a partial perspective exploded view of the electrical connector assembly and a part of a mating connector in FIG. 6.
Figure 8:
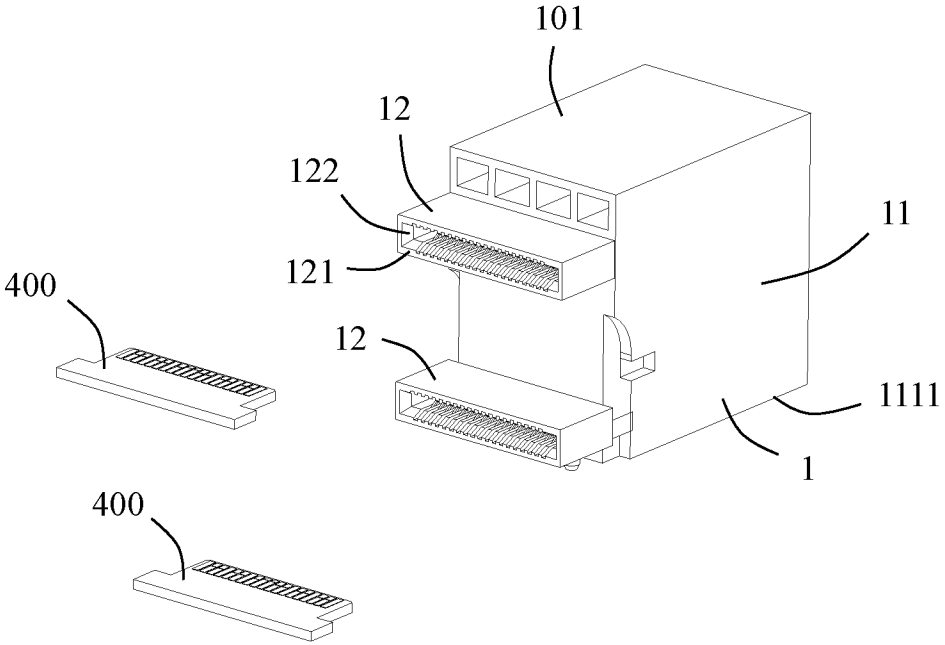
FIG. 8 is an exploded perspective view of an electrical connector and a part of the mating connector in FIG. 7.
Figure 9:
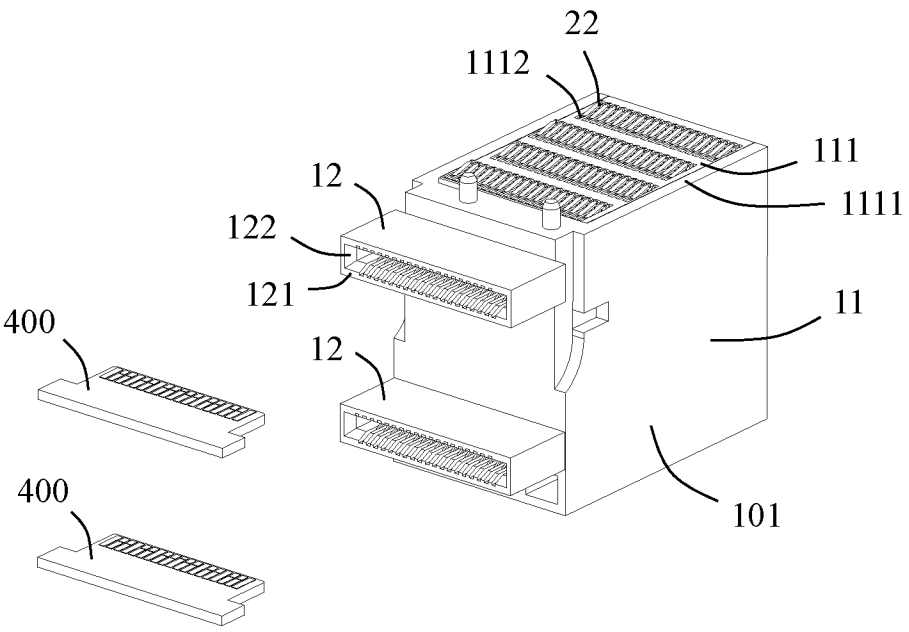
FIG. 9 is a perspective exploded view of FIG. 8 from another angle.
Figure 10:
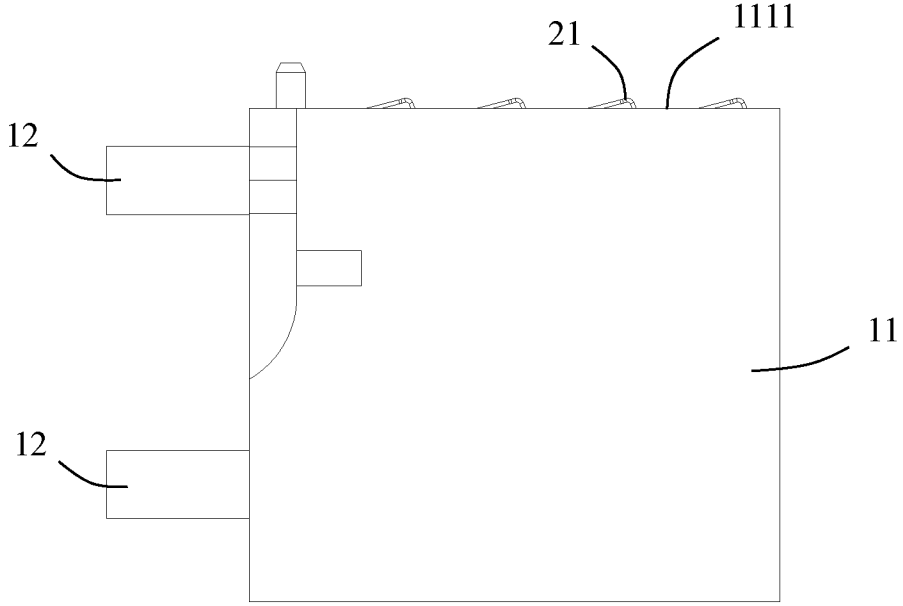
FIG. 10 is a right side view of the electrical connector in FIG. 9.
Figure 11:
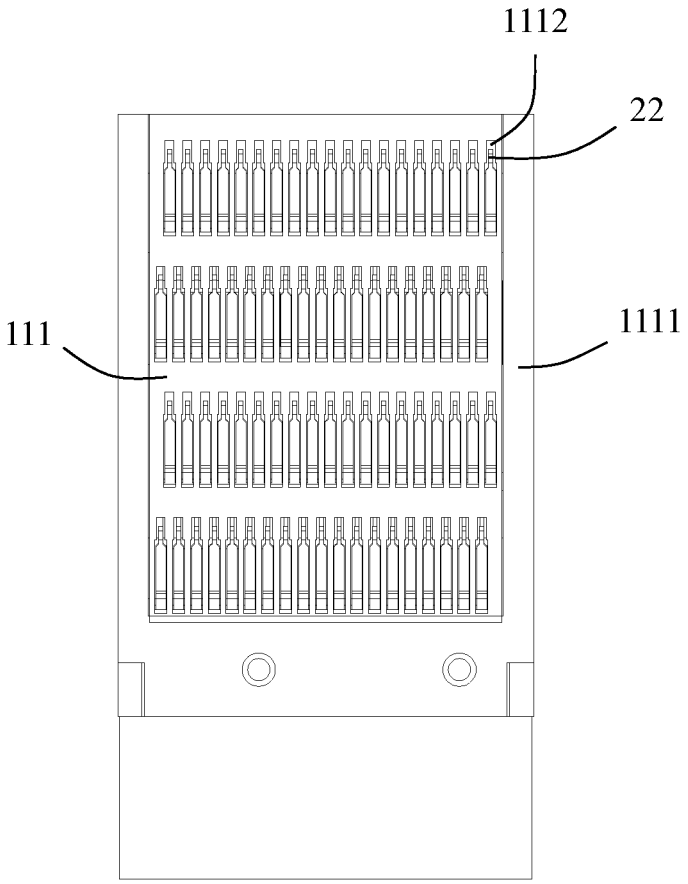
FIG. 11 is a top view of the electrical connector in FIG. 9.

Referring to FIGS. 6 and 7, the electrical connector assembly 100 includes an electrical connector 101 and a metal casing 102 shielding the electrical connector 101. In the illustrated embodiment of the present disclosure, the electrical connector 101 is a high-speed connector, such as a QSFP connector, an SFP connector, an OSFP connector, or an OSFP-DD connector etc. Of course, in other embodiments, the electrical connector 101 may also be other types of connectors. In the illustrated embodiment of the present disclosure, the electrical connector 101 includes an insulating body 1 and a plurality of conductive terminals 2 fixed to the insulating body 1. In the illustrated embodiment of the present disclosure, the electrical connector 101 has a double-layer structure, which includes two connector ports that are stacked one over the other and have the same structure. Unless otherwise specified, only one connector port is used as an example for the following description.

Specifically, referring to FIGS. 8 to 11, the insulating body 1 includes a main body portion 11 and a protruding portion 12 extending forwardly from the main body portion 11. The main body 11 includes a mounting wall 111 at the bottom thereof. The mounting wall 111 has a mounting surface 1111 for being mounted on the circuit board 200 and a plurality of opening slots 1112 arranged at intervals. The opening slots 1112 extend through the mounting surface 1111. The protruding portion 12 includes a mating surface 121 and a slot 122 extending through the mating surface 121. The slot 122 is adapted for receiving a part of the mating connector (for example, a tongue plate 400 of the mating connector).

Figure 12:
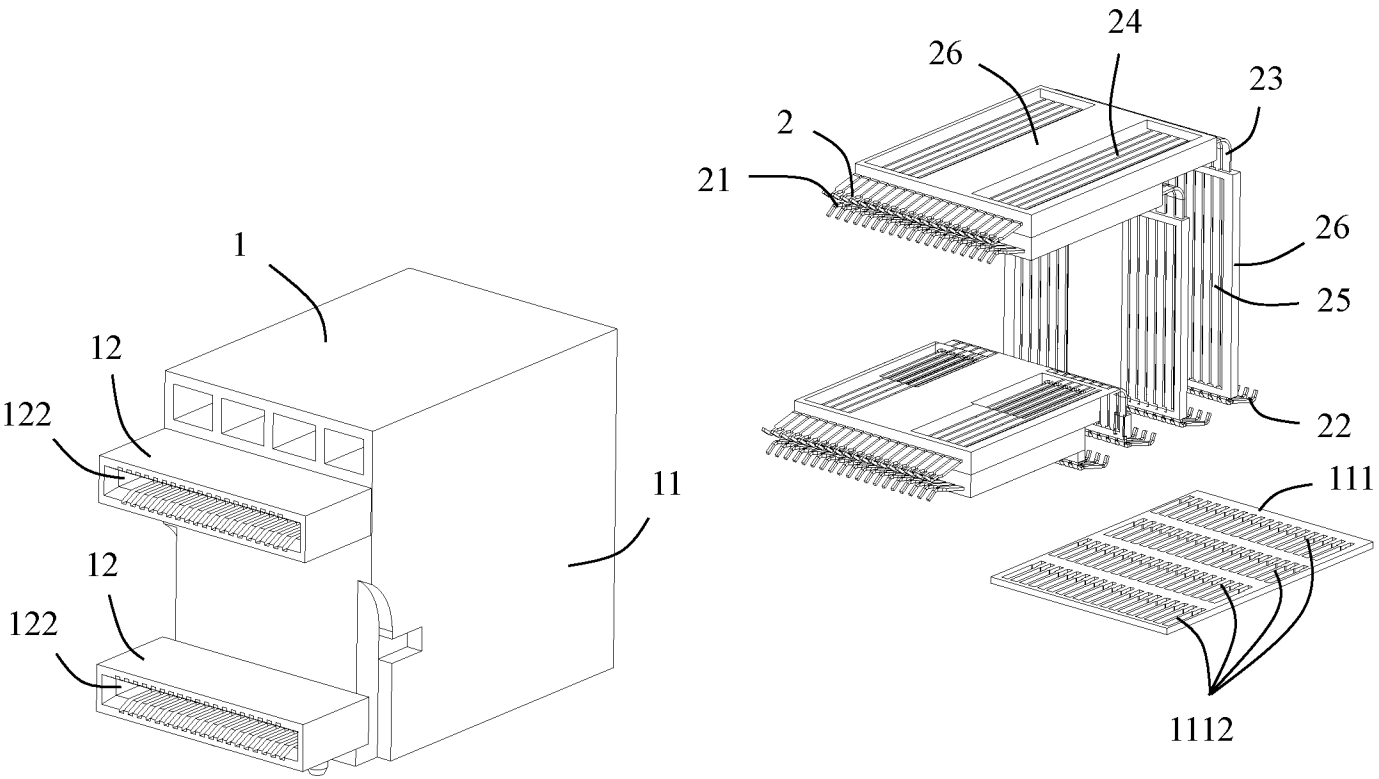
FIG. 12 is a partially exploded perspective view of the electrical connector in FIG. 8.
Figure 13:
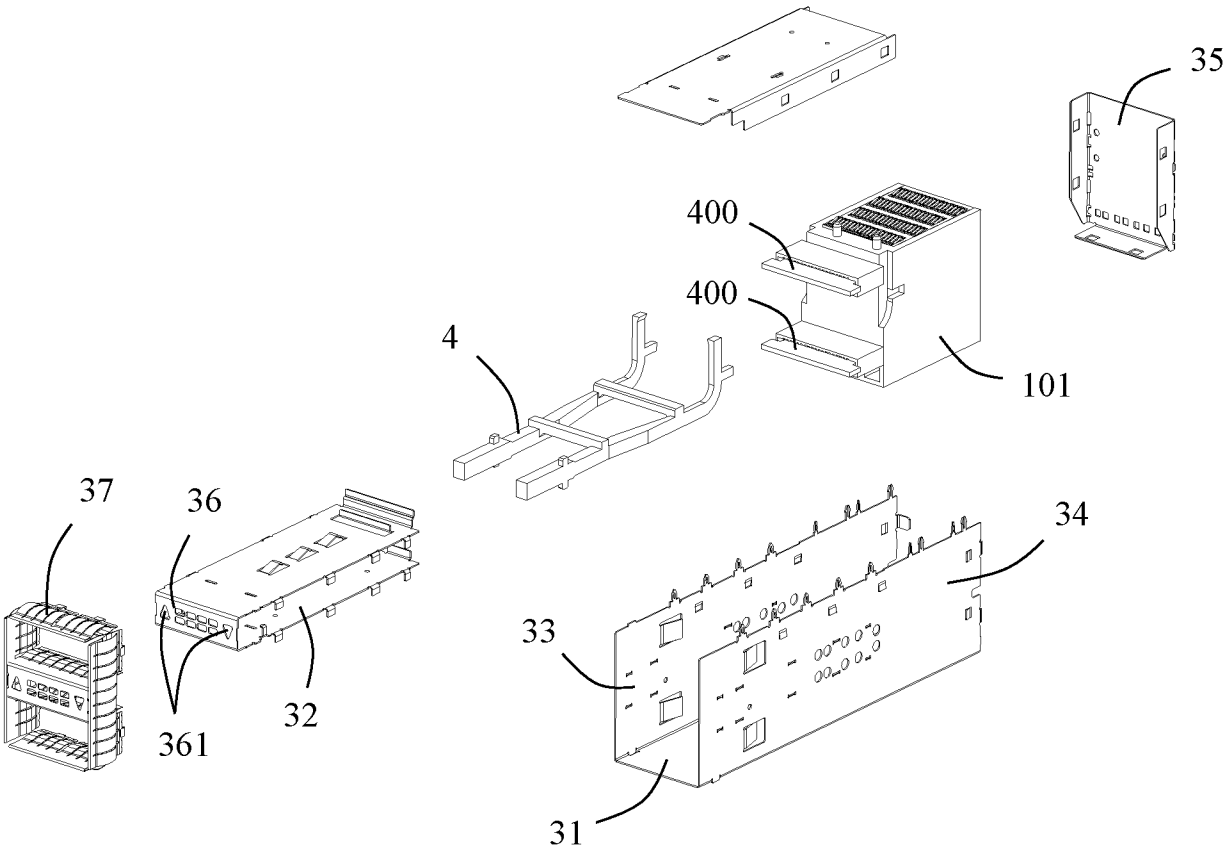
FIG. 13 is a further perspective exploded view of FIG. 7.
Figure 14:
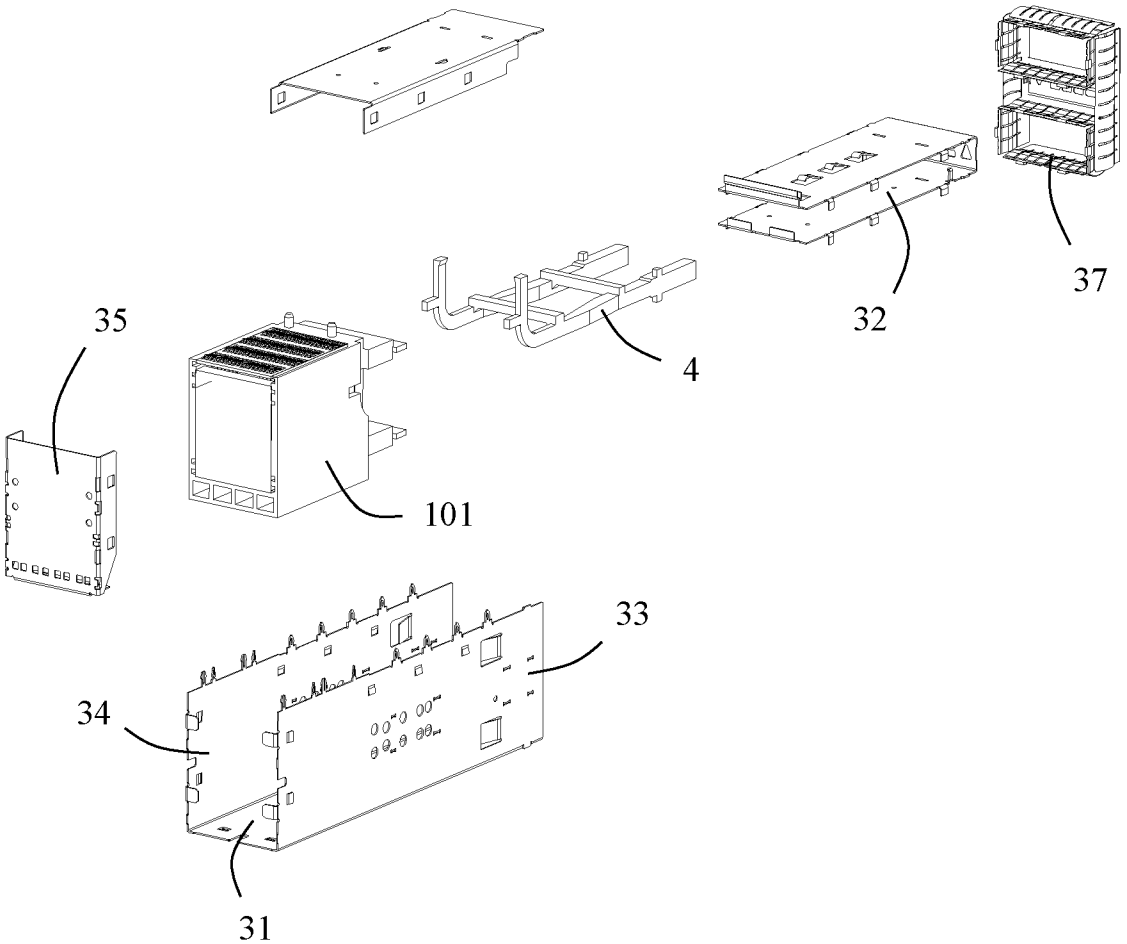
FIG. 14 is a perspective exploded view of FIG. 13 from another angle.

As shown in FIG. 12, each conductive terminal 2 includes an elastic contact portion 21 protruding into the slot 122 and an abutting portion 22 extending toward the mounting surface 1111. The abutting portion 22 protrudes beyond the mounting surface 1111. The elastic contact portion 21 is adapted for contacting with the mating connector. The abutting portions 22 are elastic and are adapted to press against the corresponding conductive pads 205 of the circuit board 200 so as to achieve electrical connection. The abutting portion 22 extends through the corresponding opening slot 1112 and further extends beyond the mounting surface 1111. By providing the opening slots 1112, on the one hand, the abutting portions 22 can be separated from each other so as to avoid short circuit; on the other hand, the opening slots 1112 provide a certain deformation space for the abutting portions 22 so as to facilitate abutting against the circuit board 200. In the illustrated embodiment of the present disclosure, the mounting wall 111 is arranged separately from the insulating body 1 and assembled to the insulating body 1.

In the illustrated embodiment of the present disclosure, each conductive terminal 2 includes a connecting portion 23 connected between the elastic contact portion 21 and the abutting portion 22. The connecting portion 23 is of a bent configuration. The conductive terminal 2 further includes a first extension portion 24 connected between the elastic contact portion 21 and the connecting portion 23, and a second extension portion 25 connected between the connecting portion 23 and the abutting portion 22. An extending direction of the first extension portion 24 is perpendicular to an extending direction of the second extension portion 25. An extending direction of the abutting portion 22 is perpendicular to the extending direction of the second extension portion 25. The abutting portion 22 extends in a direction away from the elastic contact portion 21. The abutting portion 22 and the elastic contact portion 21 are parallel to each other. The abutting portions 22 elastically abut against the circuit board 200. In the illustrated embodiment of the present disclosure, the connecting portions 23 are insert-molded in an insulating block 26 so as to form a plurality of terminal modules. In the illustrated embodiment of the present disclosure, the terminal modules are in four groups. Each two groups of the terminal modules form terminals of one connector port. Regarding one connector port, the elastic contact portions 21 located in the slot 122 are arranged in two rows along a vertical direction. The two rows of the elastic contact portions 21 jointly clamp a part of the mating connector. Of course, in other embodiments, the conductive terminals 2 can be fixed to the insulating body 1 by assembling. The combination of the conductive terminals 2 and the insulating body 1 can be flexibly adjusted according to actual requirements, which has been already well known by those skilled in the art and will not be repeated here in the present disclosure.

Referring to FIGS. 13 to 16, the metal casing 102 includes a top wall 31, a bottom wall 32, a first side wall 33 connecting one side of the top wall 31 and one side of the bottom wall 32, a second side wall 34 connecting the other side of the top wall 31 and the other side of the bottom wall 32, and a rear wall 35 at the rear end. The metal casing 102 is roughly cylindrical so as to have a better shielding effect. The top wall 31, the bottom wall 32, the first side wall 33 and the second side wall 34 are jointly enclosed so as to form a receiving cavity 30 for accommodating a most part of the mating connector (referring to FIG. 1). The receiving cavity 30 is in communication with the slot 122. The receiving cavity 30 is located at a front end of the slot 122. The slot 122 and the receiving cavity 30 are adapted for jointly receiving the mating connector.

Besides, the metal casing 102 includes a mating surface 36 and an opening 361 exposed on the mating surface 36. The electrical connector 101 also includes a light guiding member 4. One end of the light guiding member 4 extends to the opening 361, and the other end is adjacent to the circuit board 200. With this arrangement, the light of the circuit board 200 displaying the working state can be transmitted to the mating surface 36 through the light guiding member 4, thereby facilitating observation. The metal casing 102 further includes a plurality of elastic grounding claws 37 fixed to outer sides and inner sides of the top wall 31, the bottom wall 32, the first side wall 33 and the second side wall 34, respectively. The elastic grounding claws 37 are adjacent to the mating surface 36. The elastic grounding claws 37 located on the outer sides are adapted to connect the metal casing 102 with other external grounding structures, thereby increasing the grounding area and improving the shielding effect. The elastic grounding claws 37 located on the inner sides protrude into the receiving cavity 30 for engaging with the mating connector. With this arrangement, on the one hand, contacting with the mating connector can be achieved so as to increase the shielding area; on the other hand, plug-in force with the mating connector can be increased so as to improve the connection stability between the electrical connector assembly 100 and the mating connector.

Figure 15:
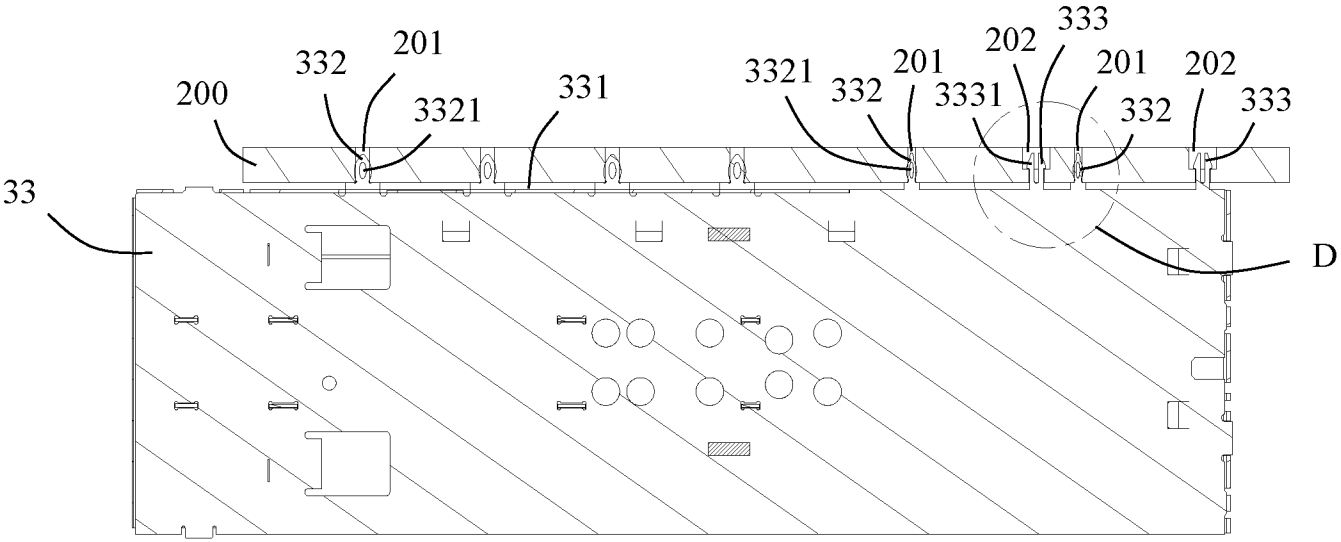
FIG. 15 is a schematic cross-sectional view taken along line A-A in FIG. 4.

Referring to FIG. 15, the first side wall 33 of the metal casing 102 includes a first side edge 331, a plurality of first mounting feet 332 protruding from the first side edge 331, and a plurality of first locking feet 333 protruding from the first side edge 331. Along the first side edge 331, two first mounting feet 332 at a rear end (for example, a right side in FIG. 15) and the first locking feet 333 are arranged alternately. Each first mounting foot 332 defines a first through hole 3321 so that the first mounting foot 332 has elasticity to be easily pressed into the corresponding first conductive hole 201 of the circuit board 200. The first locking foot 333 includes a first barb 3331 which is adapted to be inserted into the corresponding first locking hole 202 of the circuit board 200 and be fixed to the circuit board 200.

Figure 16:
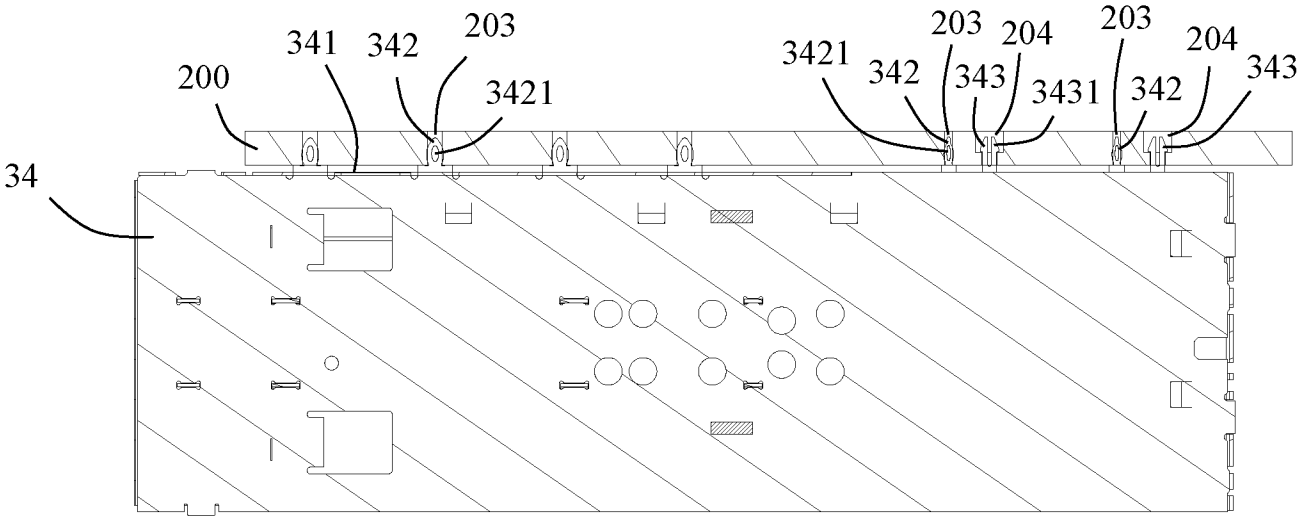
FIG. 16 is a schematic cross-sectional view taken along line B-B in FIG. 4.

Referring to FIG. 16, the second side wall 34 of the metal casing 102 includes a second side edge 341, a plurality of second mounting feet 342 protruding from the second side edge 341, and a plurality of second locking feet 343 protruding from the second side edge 341. Along the second side edge 341, two second mounting feet 342 located at a rear end (for example, a right side in FIG. 16) and the second locking feet 343 are arranged alternately. Each second mounting foot 342 defines a second through hole 3421 so that the second mounting foot 342 has elasticity to be easily pressed into the corresponding second conductive hole 203 of the circuit board 200. The second locking foot 343 includes a second barb 3431 which is adapted to be inserted into the corresponding second locking hole 204 of the circuit board 200 and be fixed to the circuit board 200. Please further combine as shown in FIG. 6, the first locking feet 333 and the second locking feet 343 are staggered along the width direction W-W perpendicular to a mating direction D-D. The two first mounting feet 332 at the rear end and the two second mounting feet 342 at the rear end are staggered along the width direction W-W perpendicular to the mating direction D-D. This arrangement facilitates the two electrical connectors on opposite sides of the circuit board 200 to be fixedly mounted with the circuit board 200, thereby realizing a modular arrangement.

Figure 19:
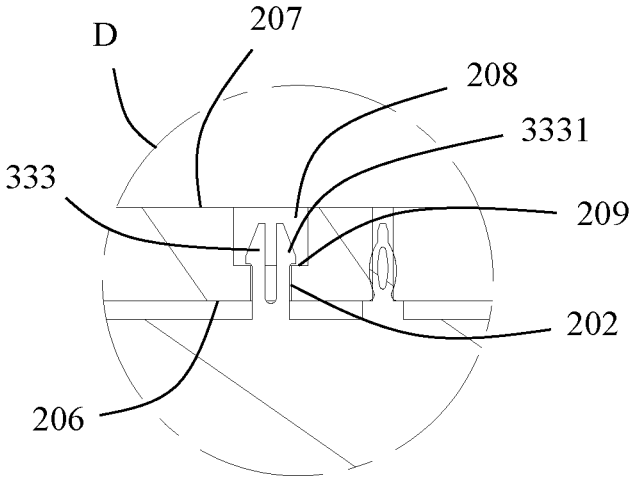
FIG. 19 is a partial enlarged view of a circled part D in FIG. 15.

Specifically, referring to FIG. 19, in the illustrated embodiment of the present disclosure, the circuit board 200 includes a first surface 206 facing the electrical connector 101 and a second surface 207 opposite to the first surface 206. The first locking holes 202 extend through the first surface 206. The circuit board 200 further includes a plurality of enlarged holes 208 extending through the second surface 207. Each enlarged hole 208 is in communication with the corresponding first locking hole 202. A diameter of the enlarged hole 208 is larger than a diameter of the first locking hole 202. Therefore, the circuit board 200 forms a locking surface 209 at a junction of the enlarged hole 208 and the first locking hole 202. When the first barb 3331 of the first locking foot 333 is inserted into the first locking hole 202 of the circuit board 200 and installed in place, the first barb 3331 is locked on the locking surface 209. As a result, the force generated when the abutting portions 22 abut against the conductive pads 205 of the circuit board 200 can be overcome, and the contact reliability between the abutting portions 22 and the circuit board 200 can be ensured. In the illustrated embodiment of the present disclosure, the first barb 3331 is located in the enlarged hole 208 and does not protrude beyond the second surface 207. With this arrangement, on the one hand, the overall height of the electrical connector 101 after being installed on the circuit board 200 is reduced; on the other hand, it also reduces the risk of the first locking feet 333 being damaged by external force.

Referring to FIG. 19, in another embodiment, the circuit board 200 further defines a mounting hole 211 and a conical surface 212 exposed to the mounting hole 211. The mounting hole 211 includes a first mounting hole 211*a*, a second mounting hole 211*b* and a third mounting hole 211*c* connected between the first mounting hole 211*a* and the second mounting hole 211*b*. The first mounting hole 211*a* is larger in diameter than the second mounting hole 211*b*. The conical surface 212 encloses the third mounting hole 211*c*.

Figure 20:
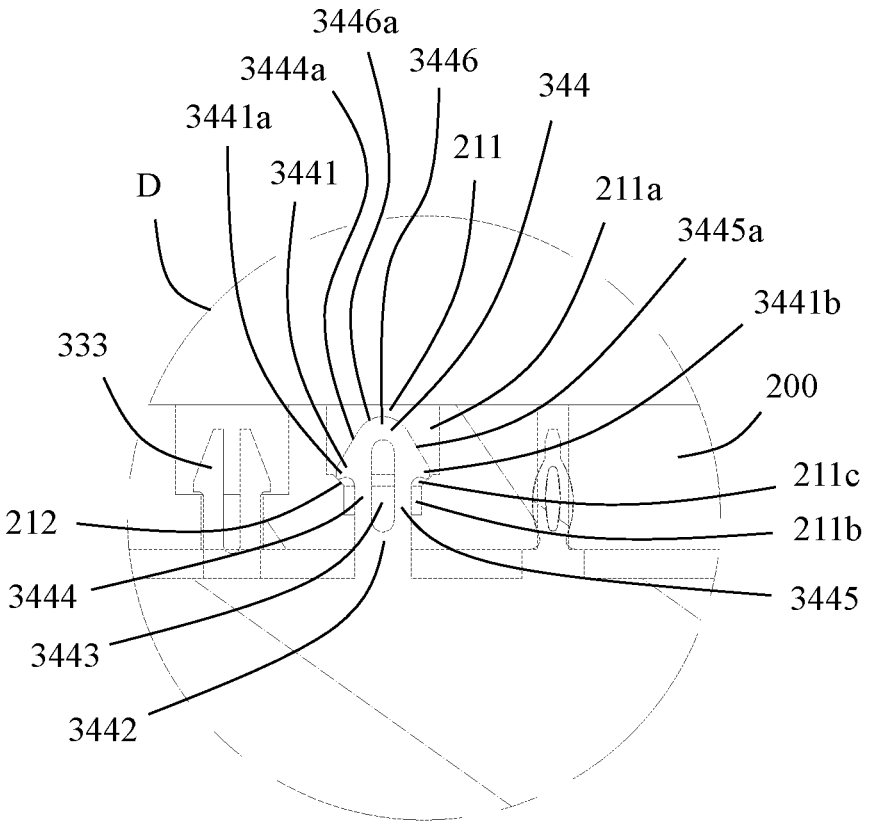
FIG. 20 is a partial enlarged view of the circled part D in FIG. 15 in anther embodiment.
Figure 21:
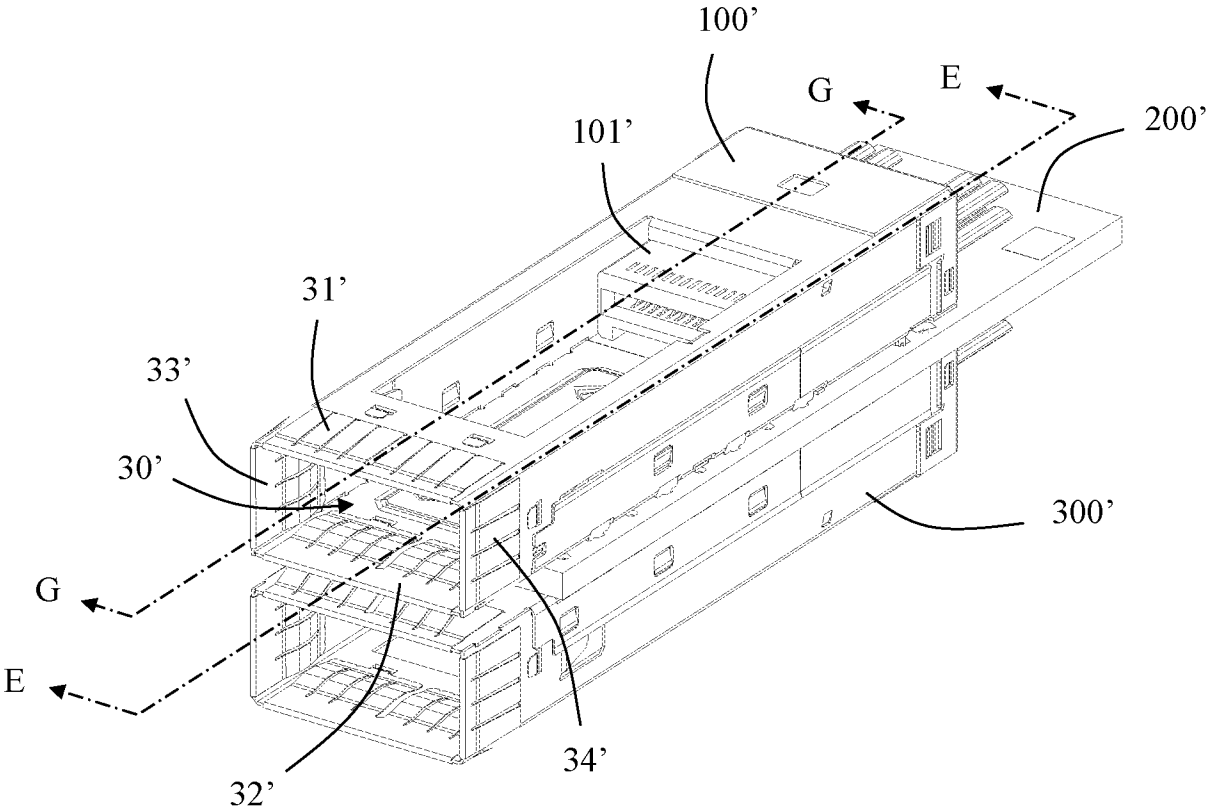
FIG. 21 is a perspective view of an electrical connector assembly in accordance with a third embodiment of the present disclosure.
Figure 22:
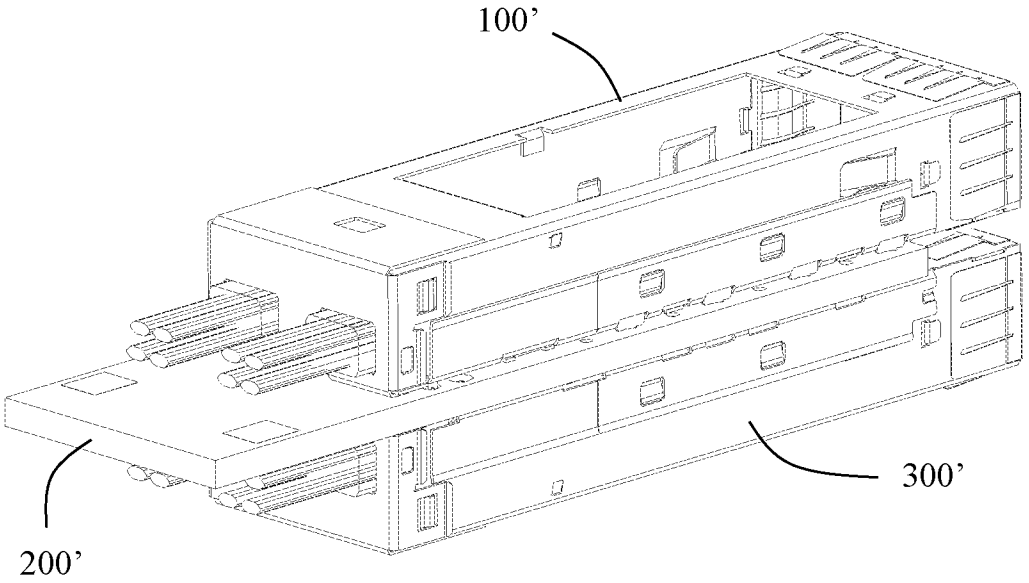
FIG. 22 is another perspective view of the electrical connector assembly shown in FIG. 21.
Figure 23:
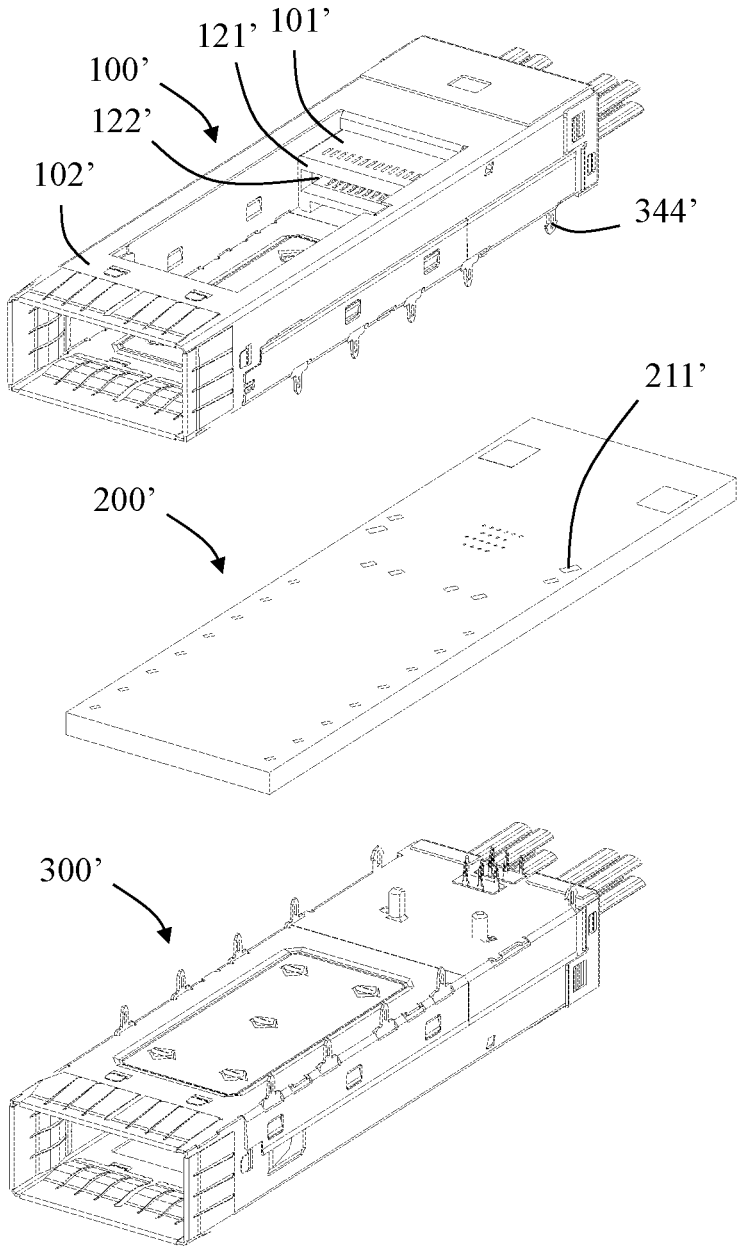
FIG. 23 is a partial exploded view of the electrical connector assembly shown in FIG. 21.
Figure 24:
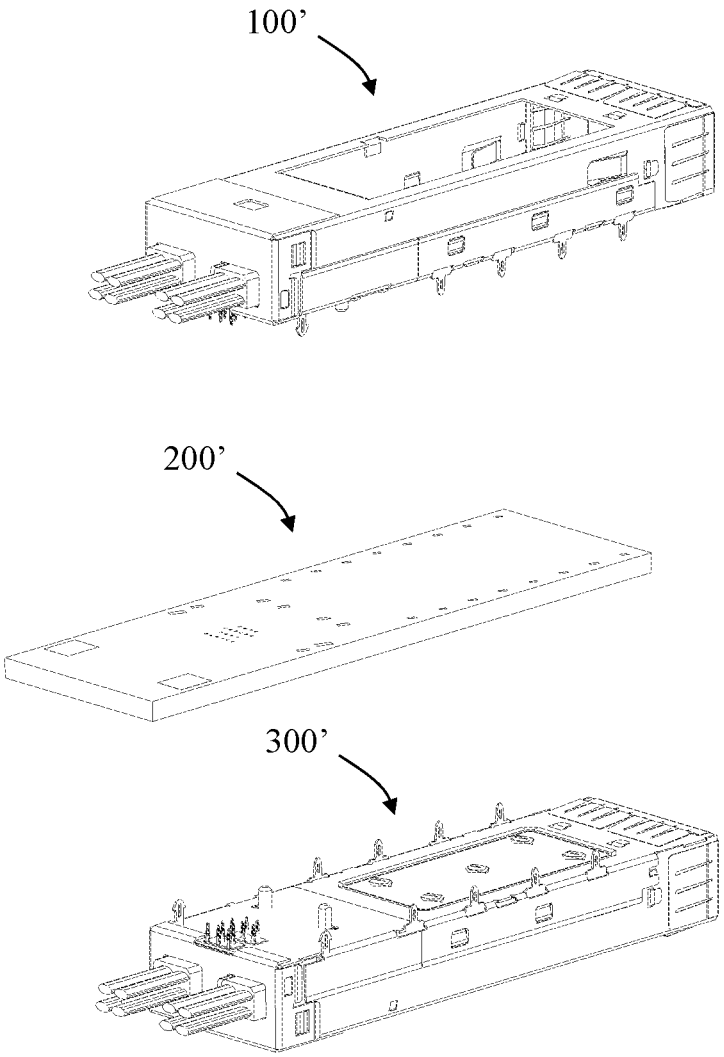
Figure 25:
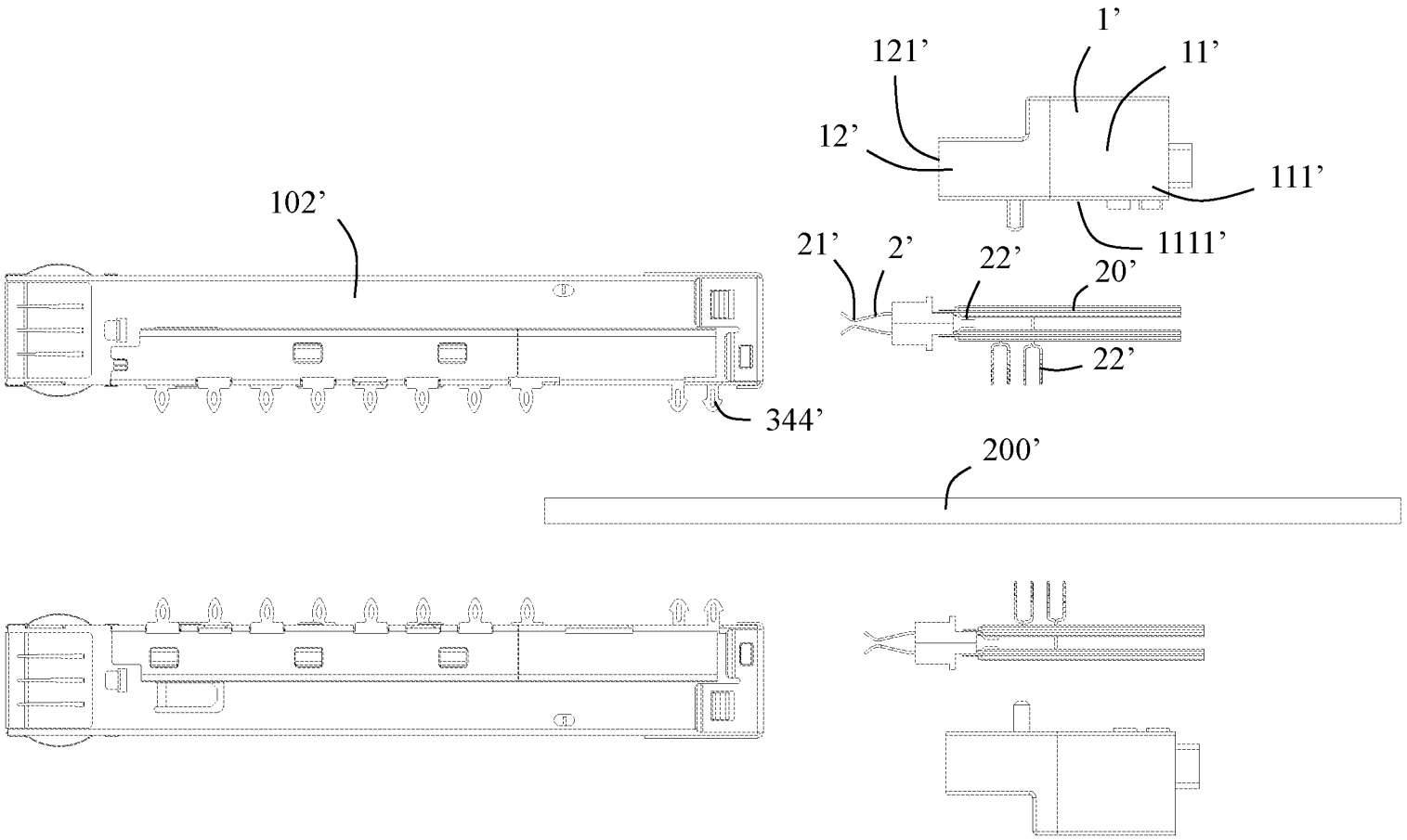
FIG. 25 is a side view of the electrical connector assembly which is further exploded based on FIG. 23.
Figure 26:
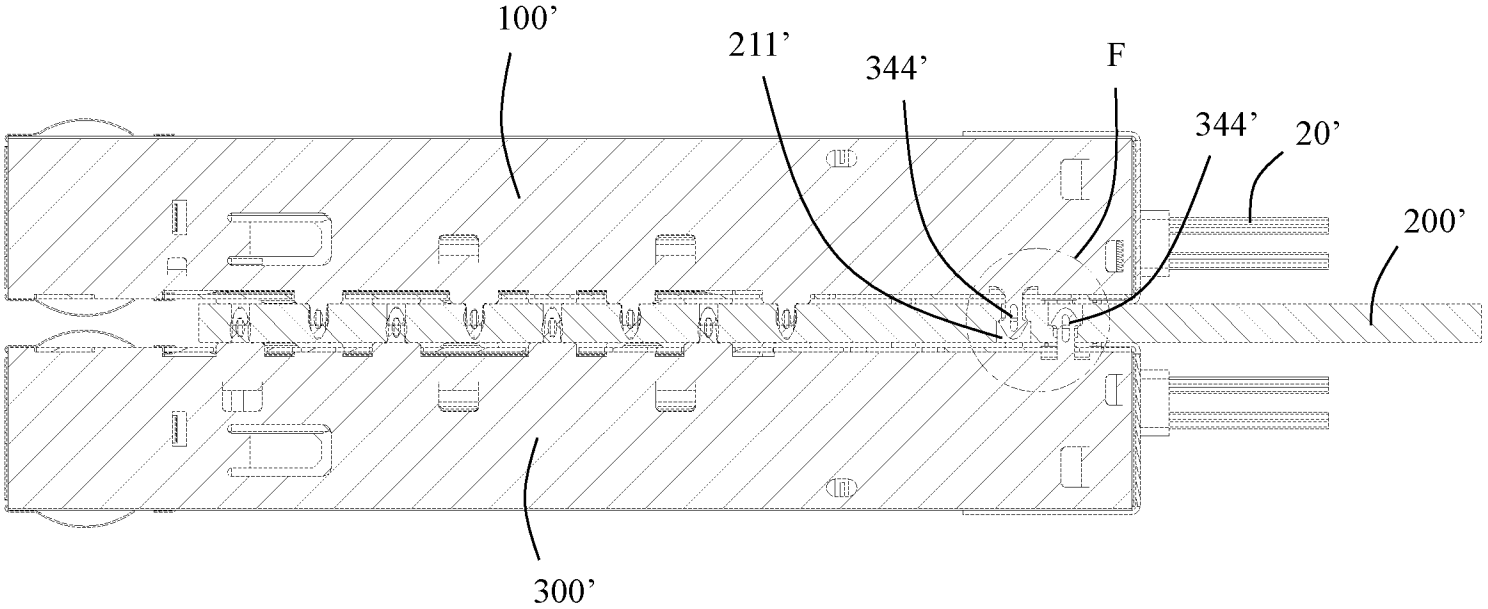
FIG. 26 is a schematic cross-sectional view taken along line E-E in FIG. 21.
Figure 27:
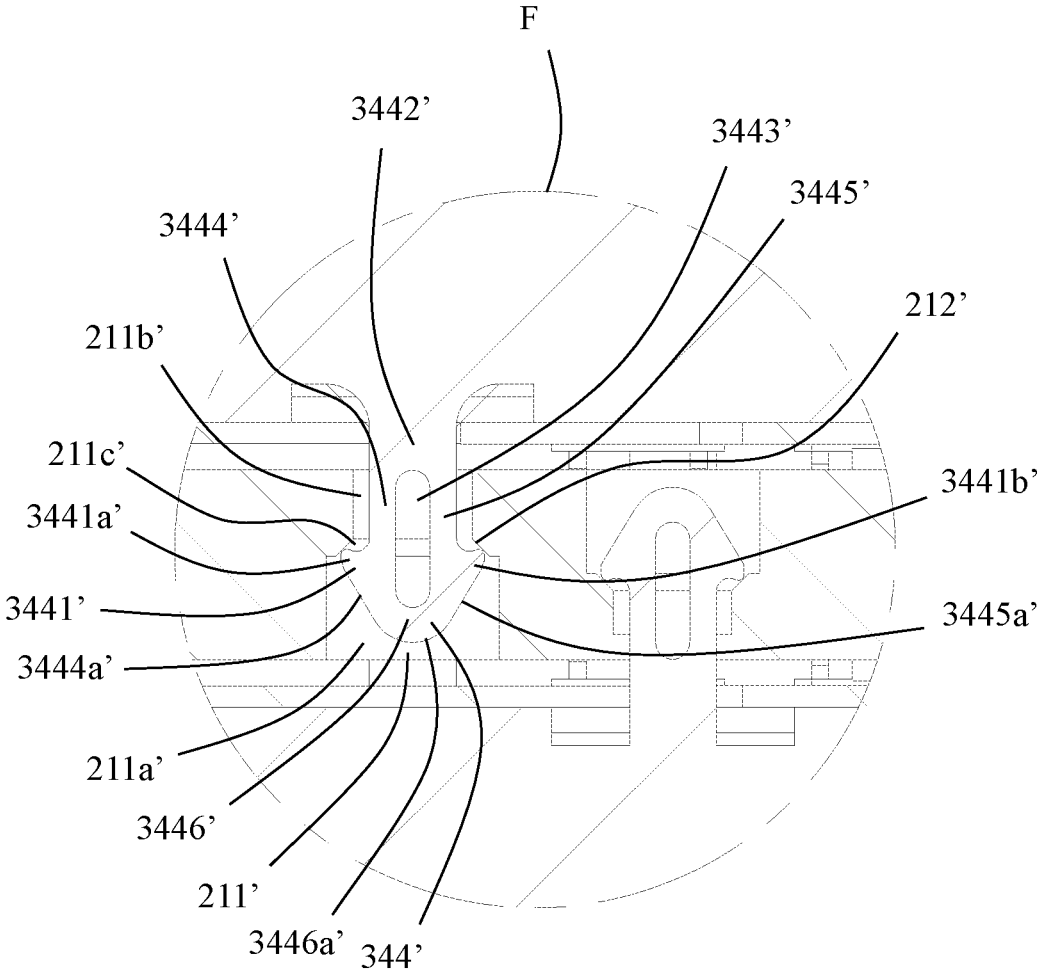
FIG. 27 is a partial enlarged view of a circled part F in FIG. 26.
Figure 28:
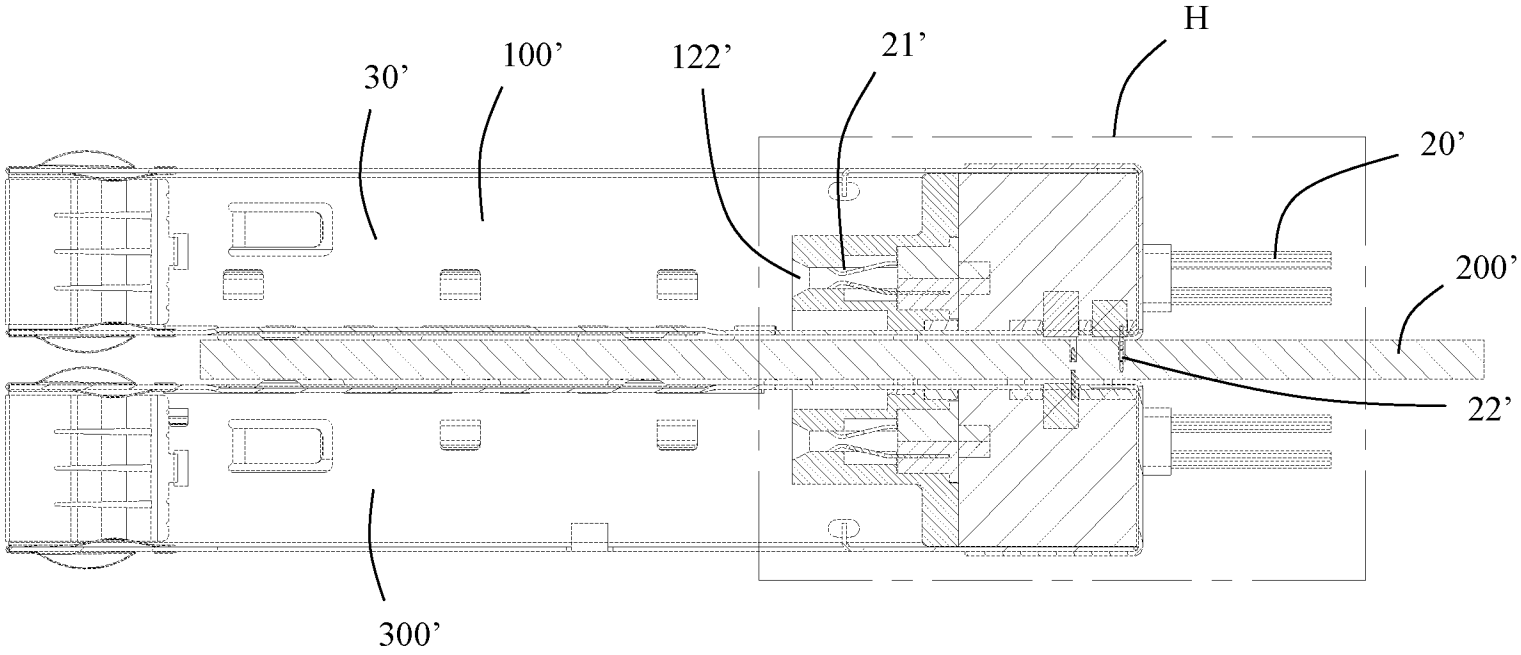
FIG. 28 is a schematic cross-sectional view taken along line G-G in FIG. 21.
Figure 29:
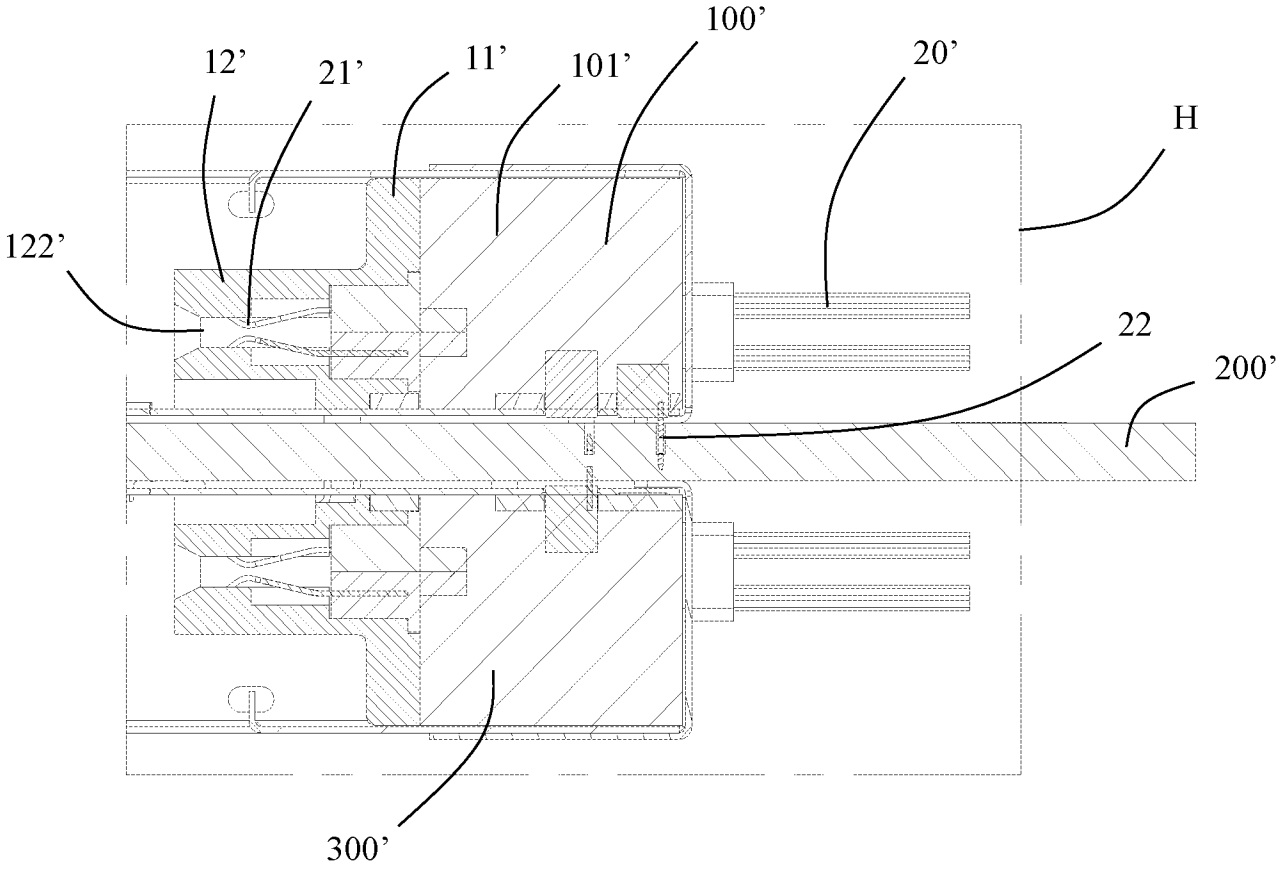
FIG. 29 is a partial enlarged view of a framed part H in FIG. 28.

At least one of the first side wall 33 and the second side wall 34 of the metal casing 102 includes a locking tab 344 inserted into the mounting hole 211. The locking tab 344 includes a hook portion 3441 locking with the conical surface 212 in order to prevent the locking tab 344 from being detaching from the circuit board 200. The locking tab 344 includes an extending portion 3442 defining a slit 3443 which is peripherally enclosed by the extending portion 3442. It means that the slit 3443 does not extending through the extending portion 3442 along an extending direction (i.e., a vertical direction) of the extending portion 3442. The locking tab 344 includes a first tab 3444 located on one side of the slit 3443, a second tab 3445 located on the other side of the slit 3443, and a connection portion 3446 connecting a free end of the first tab 3444 and a free end of the second tab 3445. The hook portion 3441 includes a first hook 3441*a* integrally formed with the first tab 3444 and a second hook 3441*b* integrally formed with the second tab 3445, and the first hook 3441*a* is opposite to the second hook 3441*b*. The first tab 3444 includes a first inclined surface 3444*a*, the second tab 3445 includes a second inclined surface 3445*a*, the connection portion 3446 includes an arced surface 3446*a* connecting with first inclined surface 3444*a* and the second inclined surface 3445*a*. The first inclined surface 3444*a*, the second inclined surface 3445*a* and the arced surface 3445 jointly guide insertion of the locking tab 344 into the mounting hole 211. As shown in FIG. 20, in the illustrated embodiment of the present disclosure, the slit 3443 extends along the vertical direction. The first tab 3444 and the second tab 3445 is deformable towards the slit 3443 when the locking tab 344 is inserted into the mounting hole 211.

Figure 17:
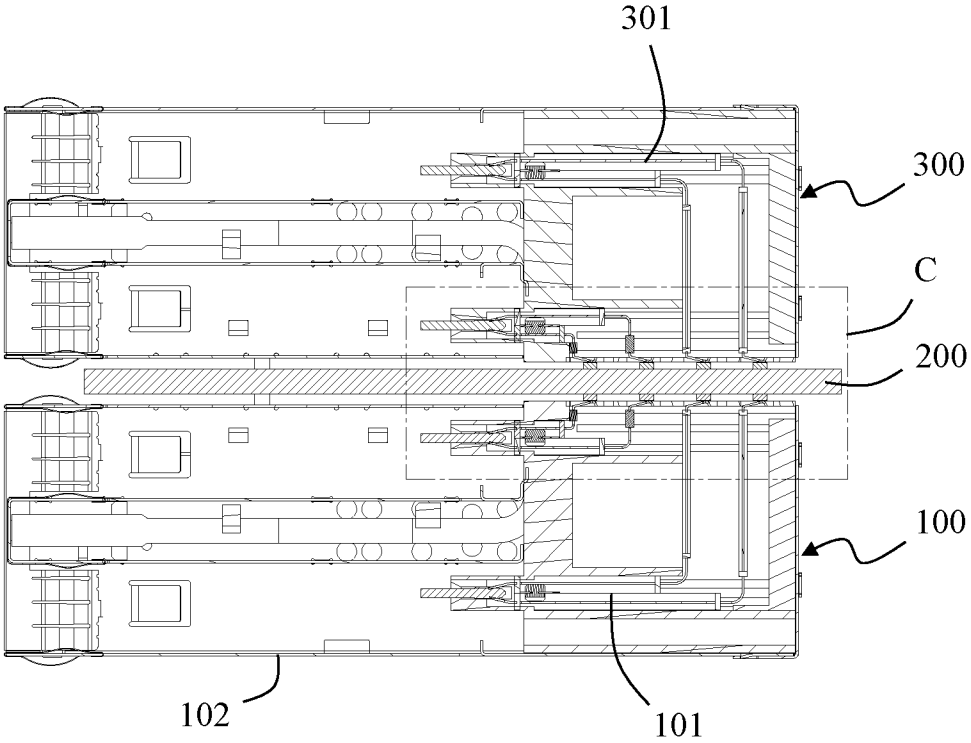
FIG. 17 is a front view of an electrical connector assembly in accordance with a second embodiment of the present disclosure.
Figure 18:
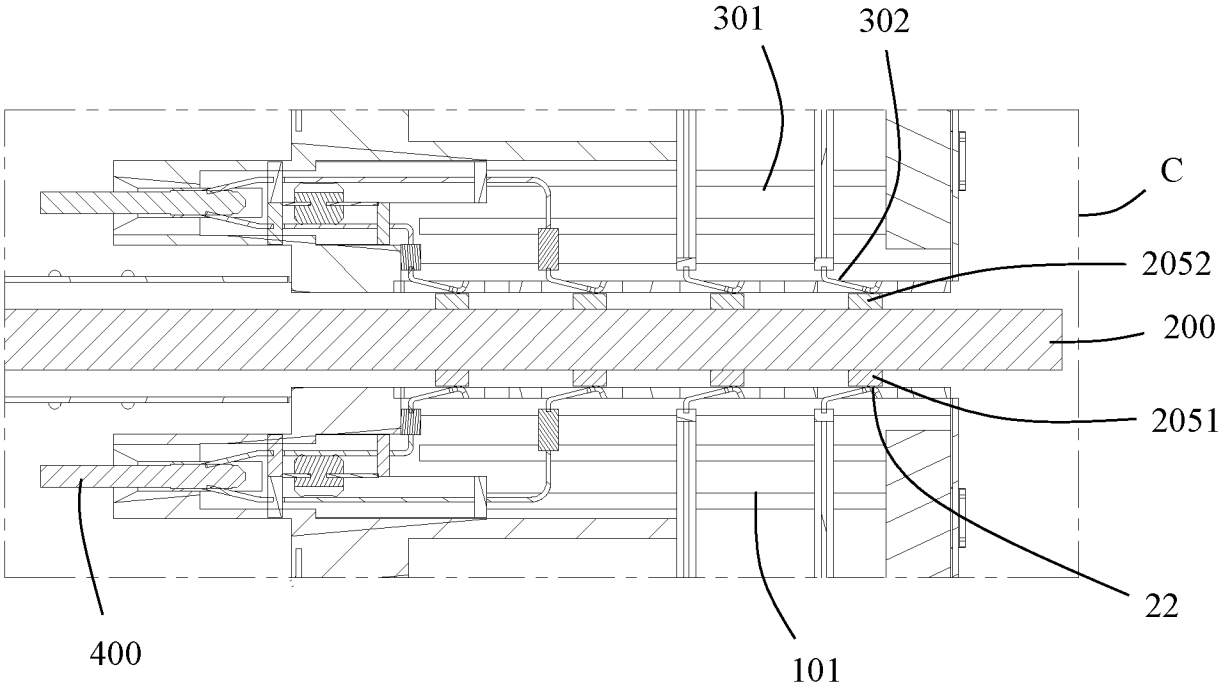
FIG. 18 is a partial enlarged view of a frame part C in FIG. 17.

Referring to FIGS. 17 and 18, the present disclosure also relates to an electrical connector assembly which includes a first electrical connector assembly, the circuit board 200 and a second electrical connector assembly 300. In the illustrated embodiment of the present disclosure, the first electrical connector assembly is the aforementioned electrical connector assembly 100. The second electrical connector assembly 300 is the same as the first electrical connector assembly. Of course, in other embodiments, the first electrical connector assembly and the second electrical connector assembly 300 can also be different. The second electrical connector assembly 300 includes a second electrical connector 301. The circuit board 200 has a first side (for example, a lower side), a plurality of first conductive pads 2051 located on the first side, a second side (for example, an upper side) opposite to the first side, and a plurality of second conductive pads 2052 located on the second side. The first electrical connector assembly is installed on the first side of the circuit board 200 and abuts against the first conductive pads 2051. The second electrical connector 301 is installed on the second side of the circuit board 200 and is electrically connected to the second conductive pads 2052. In an embodiment of the present disclosure, the conductive terminals 302 of the second electrical connector 301 elastically abut against the second conductive pads 2052. With this arrangement, since the first conductive pads 2051 and the second conductive pads 2052 are respectively arranged on opposite surfaces of the circuit board 200, it is convenient to arrange. In addition, this arrangement avoids setting through holes along a vertical direction in an area where the conductive terminals are electrically connected to the circuit board 200, thereby reducing adverse effects on signal transmission.

As shown in FIGS. 21 to 29, an electrical connector assembly in accordance with a third embodiment of the present disclosure is disclosed. The electrical connector assembly includes a first electrical connector assembly 100', a circuit board 200' and a second electrical connector assembly 300'. Compared to the electrical connector assembly 100 having the electrical connector 101 with two connector ports that are stacked one over the other as shown in FIGS. 1 to 19, the first electrical connector assembly 100' in the present disclosure, as shown in FIGS. 20 to 29, includes an electrical connector 101' having only one connector port. In the illustrated embodiment of the present invention, the first electrical connector assembly 100' and the second electrical connector assembly 300' are same connector assemblies but mounted in different angles. Of course, it is understandable to those of ordinary skill in the art, in other embodiments, the second electrical connector assembly 300' can also be an electrical connector assembly different from the first electrical connector assembly 100'.

The circuit board 200' defines a plurality of mounting holes 211' and a plurality of conical surfaces 212' exposed to the corresponding mounting holes 211'. Each mounting hole 211' includes a first mounting hole 211*a*', a second mounting hole 211*b*' and a third mounting hole 211*c*' connected between the first mounting hole 211*a*' and the second mounting hole 211*b*'. The first mounting hole 211*a*' is larger in diameter than the second mounting hole 211*b*'. The conical surface 212' encloses the third mounting hole 211*c*'. The circuit board 200' includes a first side and a second side opposite to the first side. The first electrical connector assembly 100' and the second electrical connector assembly 300' are mounted to the first side and the second side of the circuit board 200', respectively.

The electrical connector assembly 100' includes an electrical connector 101' and a metal casing 102' shielding the electrical connector 101'. In the illustrated embodiment of the present disclosure, the electrical connector 101' is a high-speed connector, such as a QSFP connector, an SFP connector, an OSFP connector, or an OSFP-DD connector etc. Of course, in other embodiments, the electrical connector 101' may also be other types of connectors. In the illustrated embodiment of the present disclosure, the electrical connector 101' includes an insulating body 1' and a plurality of conductive terminals 2' fixed to the insulating body 1' through insert-molding or assembling.

The insulating body 1' includes a main body portion 11' and a protruding portion 12' extending forwardly from the main body portion 11'. The main body 11' includes a mounting wall 111' at the bottom thereof. The mounting wall 111' has a mounting surface 1111'. The protruding portion 12' includes a mating surface 121' and a slot 122' extending through the mating surface 121'. The slot 122' is adapted for receiving a part of the mating connector (for example, a tongue plate 400 of the mating connector).

Each conductive terminal 2' includes an elastic contact portion 21' protruding into the slot 122' and an abutting portion 22' electrically connecting with the elastic contact portion 21'. The elastic contact portions 21' are adapted for contacting with the mating connector. Some of the abutting portions 22' of the conductive terminals 2' are adapted for electrically connecting with the circuit board 200', and some of the abutting portions 22' of the conductive terminals 2' are connected with a cable 20'.

The metal casing 102' includes a top wall 31', a bottom wall 32', a first side wall 33' connecting one side of the top wall 31' and one side of the bottom wall 32', and a second side wall 34' connecting the other side of the top wall 31' and the other side of the bottom wall 32'. The metal casing 102' is roughly cylindrical so as to have a better shielding effect. The top wall 31', the bottom wall 32', the first side wall 33' and the second side wall 34' are jointly enclosed so as to form a receiving cavity 30' for accommodating a most part of the mating connector. The receiving cavity 30' is in communication with the slot 122'. The receiving cavity 30' is located at a front end of the slot 122'. The slot 122' and the receiving cavity 30' are adapted for jointly receiving the mating connector.

At least one of the first side wall 33' and the second side wall 34' of the metal casing 102' includes a locking tab 344' inserted into the mounting hole 211'. The locking tab 344' includes a hook portion 3441' locking with the conical surface 212' in order to prevent the locking tab 344' from being detaching from the circuit board 200'. The locking tab 344' includes an extending portion 3442' defining a slit 3443' which is peripherally enclosed by the extending portion 3442'. It means that the slit 3443' does not extending through the extending portion 3442' along an extending direction (i.e., a vertical direction) of the extending portion 3442'. The locking tab 344' includes a first tab 3444' located on one side of the slit 3443', a second tab 3445' located on the other side of the slit 3443', and a connection portion 3446' connecting a free end of the first tab 3444' and a free end of the second tab 3445'. The hook portion 3441' includes a first hook 3441*a*' integrally formed with the first tab 3444' and a second hook 3441*b*' integrally formed with the second tab 3445', and the first hook 3441*a*' is opposite to the second hook 3441*b*'. The first tab 3444' includes a first inclined surface 3444*a*', the second tab 3445' includes a second inclined surface 3445*a*', the connection portion 3446' includes an arced surface 3446*a*' connecting with first inclined surface 3444*a*' and the second inclined surface 3445*a*'. The first inclined surface 3444*a*', the second inclined surface 3445*a*' and the arced surface 3445' jointly guide insertion of the locking tab 344' into the mounting hole 211'. As shown in FIG. 20', in the illustrated embodiment of the present disclosure, the slit 3443' extends along the vertical direction. The first tab 3444' and the second tab 3445' is deformable towards the slit 3443' when the locking tab 344' is inserted into the mounting hole 211'. When the locking tab 344' is inserted in place into the circuit board 200', the conical surface 212' functions as a lock surface to engage with the locking tab 344'. By making the hook portion 3441' of the metal casing 102' locking with the lock surface of the circuit board 200', the metal casing 102' can be prevented from detaching from the circuit board 200' in case an external force is applied to pull the cable 20'.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector assembly, comprising:

an electrical connector comprising an insulating body and a plurality of conductive terminals fixed to the insulating body, the insulating body defining a slot, each conductive terminal comprising an elastic contact portion and an abutting portion, the elastic contact portions of the conductive terminals protruding into the slot for mating with a mating connector, some of the abutting portions of the conductive terminals being adapted for electrically connecting with a circuit board, and some of the abutting portions of the conductive terminals being connected with a cable; and a metal casing shielding the electrical connector, the metal casing defining a receiving cavity in communication with the slot, the receiving cavity being located at a front end of the slot, and the slot and the receiving cavity being adapted for jointly receiving the mating connector;

wherein the circuit board comprises a mounting hole and a conical surface exposed to the mounting hole;

wherein the metal casing comprises a locking tab inserted into the mounting hole, the locking tab comprises a hook portion locking with the conical surface in order to prevent the locking tab from being detaching from the circuit board;

wherein the mounting hole comprises a first mounting hole, a second mounting hole and a third mounting hole connected between the first mounting hole and the second mounting hole, the first mounting hole is larger in diameter than the second mounting hole, the conical surface encloses the third mounting hole; and wherein the locking tab is inserted into the first mounting hole, the second mounting hole and the third mounting hole.

2. The electrical connector assembly according to claim 1, wherein the locking tab comprises an extending portion defining a slit which is peripherally enclosed by the extending portion, the locking tab includes a first tab located on one side of the slit, a second tab located on the other side of the slit, and a connection portion connecting a free end of the first tab and a free end of the second tab; the hook portion comprises a first hook integrally formed with the first tab and a second hook integrally formed with the second tab, and the first hook is opposite to the second hook.

3. The electrical connector assembly according to claim 2, wherein the first tab comprises a first inclined surface, the second tab comprises a second inclined surface, the connection portion comprises an arced surface connecting with first inclined surface and the second inclined surface; the first inclined surface, the second inclined surface and the arced surface jointly guide insertion of the locking tab into the mounting hole.

4. The electrical connector assembly according to claim 1, wherein the metal casing comprises a first side edge, a plurality of first mounting feet protruding from the first side edge, a second side edge and a plurality of second mounting feet protruding from the second side edge; wherein the first side edge and the second side edge are located on opposite sides of the metal casing, respectively; and wherein the first mounting feet and the second mounting feet are arranged staggered along a width direction perpendicular to a mating direction.

5. The electrical connector assembly according to claim 4, wherein each first mounting foot defines a first through hole so that the first mounting foot has elasticity so as to be easily pressed into a first conductive hole of the circuit board; and wherein each second mounting foot defines a second through hole so that the second mounting foot has elasticity so as to be easily pressed into a second conductive hole of the circuit board.

6. The electrical connector assembly according to claim 5, wherein the metal casing comprises a plurality of first locking feet protruding from the first side edge and a plurality of second locking feet protruding from the second side edge, the first locking feet and the second locking feet are arranged staggered along the width direction perpendicular to the mating direction, each first locking foot comprises a first barb, each second locking foot comprises a second barb, the first barb is adapted for being inserted into a first locking hole of the circuit board so as to be fixed with the circuit board, and the second barb is adapted for being inserted into a second locking hole of the circuit board so as to be fixed with the circuit board.

7. The electrical connector assembly according to claim 6, wherein along the first side edge, at least parts of the first mounting feet and the first locking feet are alternately disposed; and wherein along the second side edge, at least parts of the second mounting feet and the second locking feet are alternately disposed.

8. The electrical connector assembly according to claim 1, wherein the insulating body comprises a mounting wall having a mounting surface, the mounting wall comprises a plurality of opening slots arranged at intervals, and the abutting portions adapted for pressing against the circuit board extend through the opening slots to extend beyond the mounting surface.

9. The electrical connector assembly according to claim 1, wherein the metal casing comprises a top wall, a bottom wall, a first side wall connecting one side of the top wall and one side of the bottom wall, and a second side wall connecting the other side of the top wall and the other side of the bottom wall; and wherein the receiving cavity is jointly enclosed by the top wall, the bottom wall, the first side wall and the second side wall.

10. The electrical connector assembly according to claim 1, wherein the metal casing comprises a mating surface and an opening exposed on the mating surface; and wherein the electrical connector comprises a light guiding member extending to the opening.

11. The electrical connector assembly according to claim 1, wherein the elastic contact portions disposed in the slot are arranged in two rows, and the two rows of the elastic contact portions jointly clamp a part of the mating connector.

12. An electrical connector assembly, comprising:

an electrical connector comprising an insulating body and a plurality of conductive terminals fixed to the insulating body, the insulating body defining a slot, each conductive terminal comprising an elastic contact portion and an abutting portion, the elastic contact portions of the conductive terminals protruding into the slot for mating with a mating connector, some of the abutting portions of the conductive terminals being adapted for electrically connecting with a circuit board, and some of the abutting portions of the conductive terminals being connected with a cable; and a metal casing shielding the electrical connector, the metal casing defining a receiving cavity in communication with the slot, the receiving cavity being located at a front end of the slot, and the slot and the receiving cavity being adapted for jointly receiving the mating connector;

wherein the metal casing comprises a first side edge, a plurality of first mounting feet protruding from the first side edge, a second side edge and a plurality of second mounting feet protruding from the second side edge; wherein the first side edge and the second side edge are located on opposite sides of the metal casing, respectively;

wherein the metal casing comprises a plurality of first locking feet protruding from the first side edge and a plurality of second locking feet protruding from the second side edge, each first locking foot comprises a first barb, each second locking foot comprises a second barb, the first barb is adapted for being inserted into a first locking hole of the circuit board so as to be fixed with the circuit board, and the second barb is adapted for being inserted into a second locking hole of the circuit board so as to be fixed with the circuit board; and wherein the circuit board comprises a first surface facing the electrical connector assembly and a second surface opposite to the first surface, the first locking hole extends through the first surface, the circuit board further comprises an enlarged hole extending through the second surface, the enlarged hole is in communication with the first locking hole, the circuit board forms a locking surface at a junction of the enlarged hole and the first locking hole, and the first barb is locked on the locking surface.

13. The electrical connector assembly according to claim 12, wherein the first mounting feet and the second mounting feet are arranged staggered along a width direction perpendicular to a mating direction; and wherein the first locking feet and the second locking feet are arranged staggered along the width direction perpendicular to the mating direction.

14. The electrical connector assembly according to claim 13, wherein each first mounting foot defines a first through hole so that the first mounting foot has elasticity so as to be easily pressed into a first conductive hole of the circuit board; and wherein each second mounting foot defines a second through hole so that the second mounting foot has elasticity so as to be easily pressed into a second conductive hole of the circuit board.

15. An electrical connector assembly, comprising:

a first electrical connector assembly;

a second electrical connector; and a circuit board comprising a first side and a second side opposite to the first side;

the first electrical connector assembly comprising:

an electrical connector comprising an insulating body and a plurality of conductive terminals fixed to the insulating body, the insulating body comprising a slot, each conductive terminal comprising an elastic contact portion and an abutting portion, the elastic contact portions of the conductive terminals protruding into the slot for mating with a mating connector, wherein the abutting portions of the plurality of conductive terminals are hybrid, in which some of the abutting portions of the conductive terminals are mechanically and electrically connected with the circuit board, and some of the abutting portions of the conductive terminals are mechanically and electrically connected with a cable; and wherein the cable is neither mechanically or electrically connected with the circuit board; and a metal casing shielding the electrical connector, the metal casing defining a receiving cavity in communication with the slot, the receiving cavity being located at a front end of the slot, and the slot and the receiving cavity being adapted for receiving the mating connector;

wherein the first electrical connector assembly is mounted to the first side of the circuit board, and the second electrical connector is mounted to the second side of the circuit board.

16. The electrical connector assembly according to claim 15, wherein the circuit board comprises a mounting hole and a conical surface exposed to the mounting hole; and wherein the metal casing comprises a locking tab inserted into the mounting hole, the locking tab comprises a hook portion locking with the conical surface in order to prevent the locking tab from being detaching from the circuit board.

17. The electrical connector assembly according to claim 16, wherein the locking tab comprises an extending portion defining a slit which is peripherally enclosed by the extending portion, the locking tab includes a first tab located on one side of the slit, a second tab located on the other side of the slit, and a connection portion connecting a free end of the first tab and a free end of the second tab; the hook portion comprises a first hook integrally formed with the first tab and a second hook integrally formed with the second tab, and the first hook is opposite to the second hook.

18. The electrical connector assembly according to claim 17, wherein the first tab comprises a first inclined surface, the second tab comprises a second inclined surface, the connection portion comprises an arced surface connecting with first inclined surface and the second inclined surface; the first inclined surface, the second inclined surface and the arced surface jointly guide insertion of the locking tab into the mounting hole.

19. The electrical connector assembly according to claim 16, wherein the mounting hole comprises a first mounting hole, a second mounting hole and a third mounting hole connected between the first mounting hole and the second mounting hole, the first mounting hole is larger in diameter than the second mounting hole, the conical surface encloses the third mounting hole; and wherein the locking tab is inserted into the first mounting hole, the second mounting hole and the third mounting hole.

20. The electrical connector assembly according to claim 15, wherein the metal casing comprises a first side edge, a plurality of first mounting feet protruding from the first side edge, a second side edge and a plurality of second mounting feet protruding from the second side edge; wherein the first side edge and the second side edge are located on opposite sides of the metal casing, respectively;

wherein the metal casing comprises a plurality of first locking feet protruding from the first side edge and a plurality of second locking feet protruding from the second side edge, each first locking foot comprises a first barb, each second locking foot comprises a second barb, the first barb is adapted for being inserted into a first locking hole of the circuit board so as to be fixed with the circuit board, and the second barb is adapted for being inserted into a second locking hole of the circuit board so as to be fixed with the circuit board; and wherein the circuit board comprises a first surface facing the first electrical connector assembly and a second surface opposite to the first surface, the first locking hole extends through the first surface, the circuit board further comprises an enlarged hole extending through the second surface, the enlarged hole is in communication with the first locking hole, the circuit board forms a locking surface at a junction of the enlarged hole and the first locking hole, and the first barb is locked on the locking surface.

* * * * *